US012663205B2

(12) United States Patent
Lim et al.

(10) Patent No.: US 12,663,205 B2
(45) Date of Patent: Jun. 23, 2026

(54) REFRIGERATOR

(71) Applicant: LG ELECTRONICS INC., Seoul (KR)

(72) Inventors: Hyun Ae Lim, Seoul (KR); Younghoon Gwak, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 104 days.

(21) Appl. No.: 18/580,991

(22) PCT Filed: Jun. 13, 2022

(86) PCT No.: PCT/KR2022/008325

§ 371 (c)(1),
(2) Date: Jan. 19, 2024

(87) PCT Pub. No.: WO2023/008735

PCT Pub. Date: Feb. 2, 2023

(65) Prior Publication Data

US 2024/0337433 A1 Oct. 10, 2024

(30) Foreign Application Priority Data

Jul. 26, 2021 (KR) ..... 10-2021-0097907
Jul. 26, 2021 (KR) ..... 10-2021-0097908

(51) Int. Cl.
*F25D 25/02* (2006.01)
*A47B 96/02* (2006.01)
*F25D 23/06* (2006.01)

(52) U.S. Cl.
CPC ..... *F25D 25/025* (2013.01); *F25D 25/02* (2013.01); *F25D 25/024* (2013.01);
(Continued)

(58) Field of Classification Search
CPC .... F25D 25/025; F25D 25/024; F25D 23/067; F25D 2325/021; F25D 25/02;
(Continued)

(56) References Cited

U.S. PATENT DOCUMENTS 2,825,999 A * 3/1958 Dompieri ..... B43L 5/00 52/717.06
5,273,354 A * 12/1993 Herrmann ..... F25D 25/02 312/408
(Continued)

FOREIGN PATENT DOCUMENTS

JP 2006-275504 A 10/2006
KR 10-2005-0102818 A 10/2005
(Continued)

*Primary Examiner* — Kimberley S Wright
(74) *Attorney, Agent, or Firm* — Birch, Stewart, Kolasch & Birch, LLP

(57) ABSTRACT

Proposed is a refrigerator. The refrigerator may include a cabinet having a storage compartment (3) formed therein, and a storage assembly (100) installed in the storage compartment (3) and having a storage space (130*a*) defined therein. Additionally, a guide frame (110) provided with a drawer guide part (121) and a shelf guide part (125) having heights different from each other may be provided in the storage assembly (100), and a storage drawer (130) and a plurality of shelves (150, 170) may be disposed in the guide frame (110). In this case, each of the shelves (150, 170) includes a shelf frame (151, 171), and a top plate (160, 180) coupled to the upper surface of the shelf frame (151, 171).

17 Claims, 11 Drawing Sheets

(52) U.S. Cl.
CPC ..... *A47B 96/025* (2013.01); *A47B 2210/07* (2013.01); *A47B 2210/08* (2013.01); *A47B 2210/175* (2013.01); *F25D 23/067* (2013.01); *F25D 2325/021* (2013.01)

(58) Field of Classification Search
CPC ..... F25D 2325/022; A47B 96/025; A47B 96/062; A47B 2210/175; A47B 2210/07; A47B 2210/08
See application file for complete search history.

(56) References Cited

U.S. PATENT DOCUMENTS 5,297,486 A * 3/1994 Herrmann ..... A47B 96/062 248/250
5,944,324 A * 8/1999 Schultheis ..... B29C 45/14434 277/642
6,811,045 B1 * 11/2004 Masker ..... F25D 25/02 211/153
2005/0156494 A1 * 7/2005 Bergmann ..... A47B 88/493 312/404
2006/0213849 A1 * 9/2006 Bienick ..... F25D 25/02 211/90.02
2009/0051257 A1 * 2/2009 Picken ..... F25D 25/024 211/153
2011/0001415 A1 * 1/2011 Park ..... F25D 25/02 211/150
2012/0273504 A1 * 11/2012 Rackley ..... F25D 25/025 220/592.02
2016/0238307 A1 8/2016 Lee
2022/0082321 A1 * 3/2022 Bassler ..... F25D 25/024
2023/0258394 A1 * 8/2023 Özer ..... F25D 25/024 62/382

FOREIGN PATENT DOCUMENTS

KR 10-0756887 B1 9/2007
KR 10-2008-0066452 A 7/2008
WO WO-2014082858 A1 * 6/2014 ..... F25D 25/02

* cited by examiner

[Fig. 1]
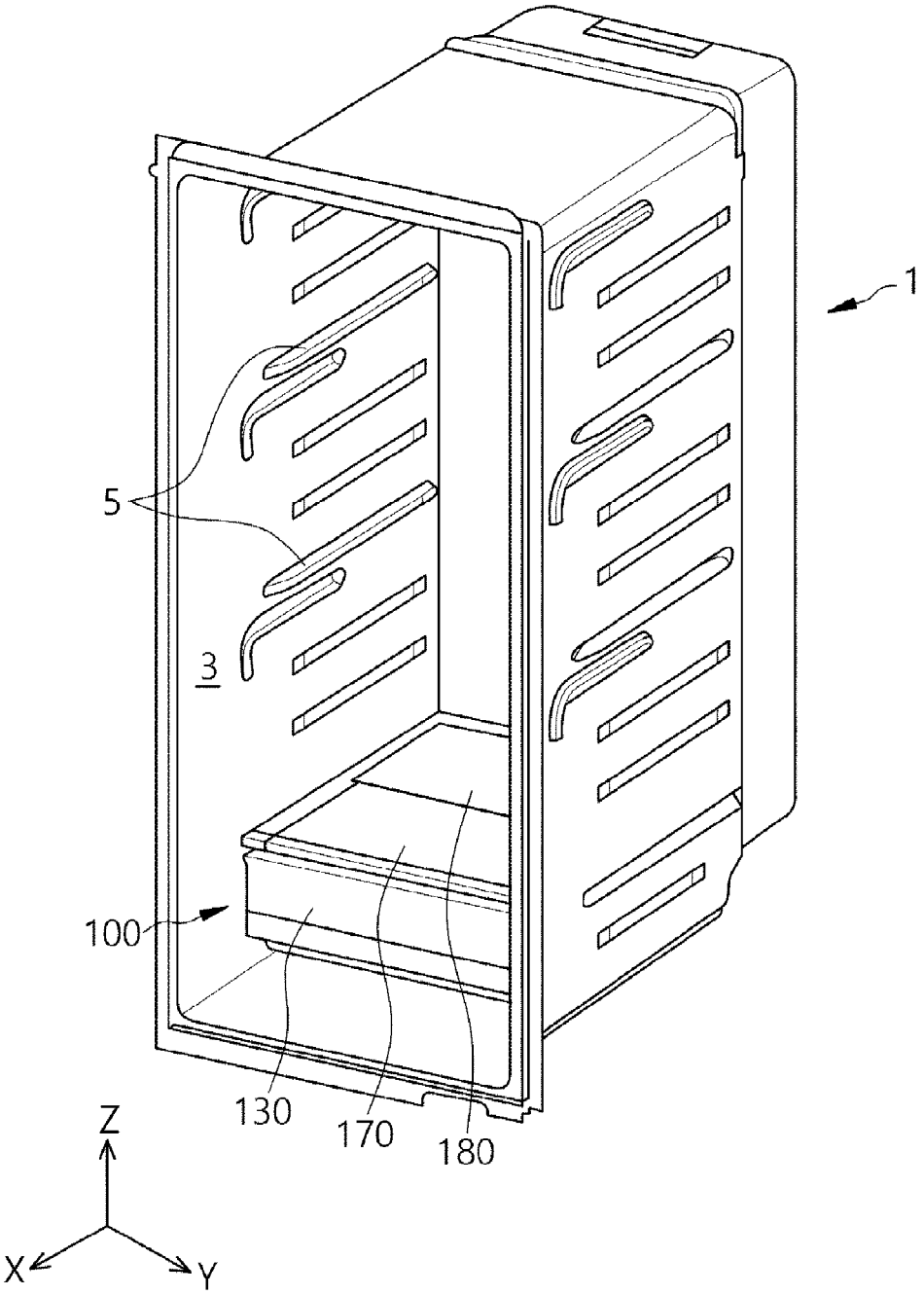

[Fig. 2]
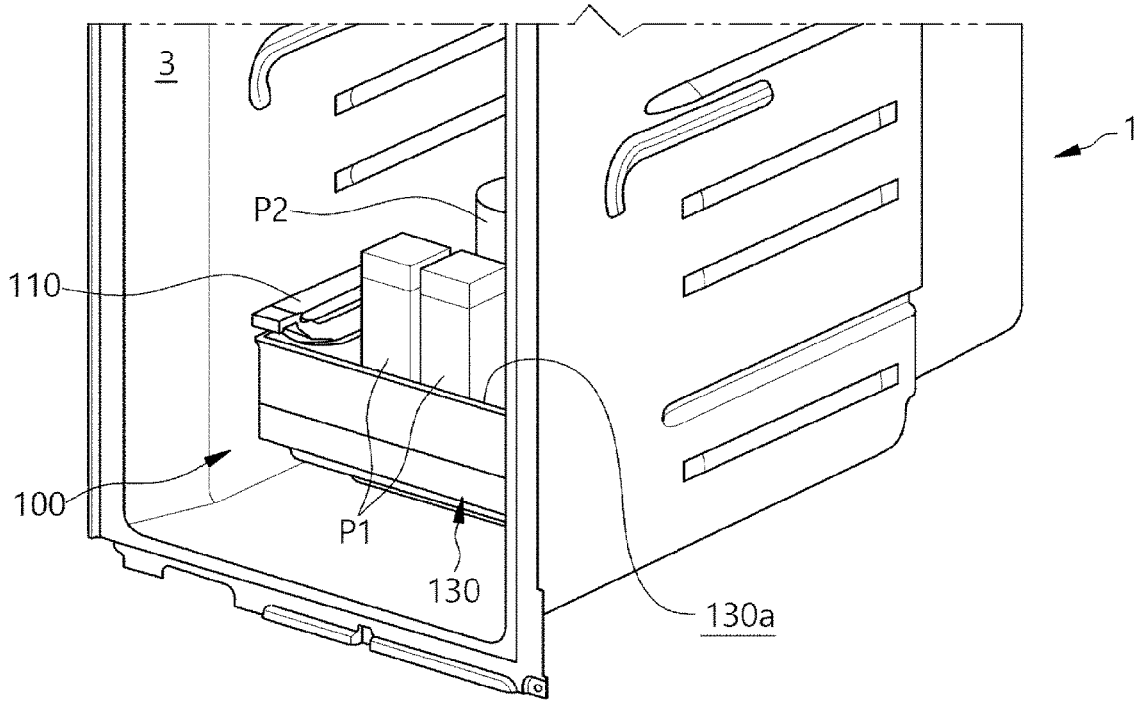
[Fig. 3]
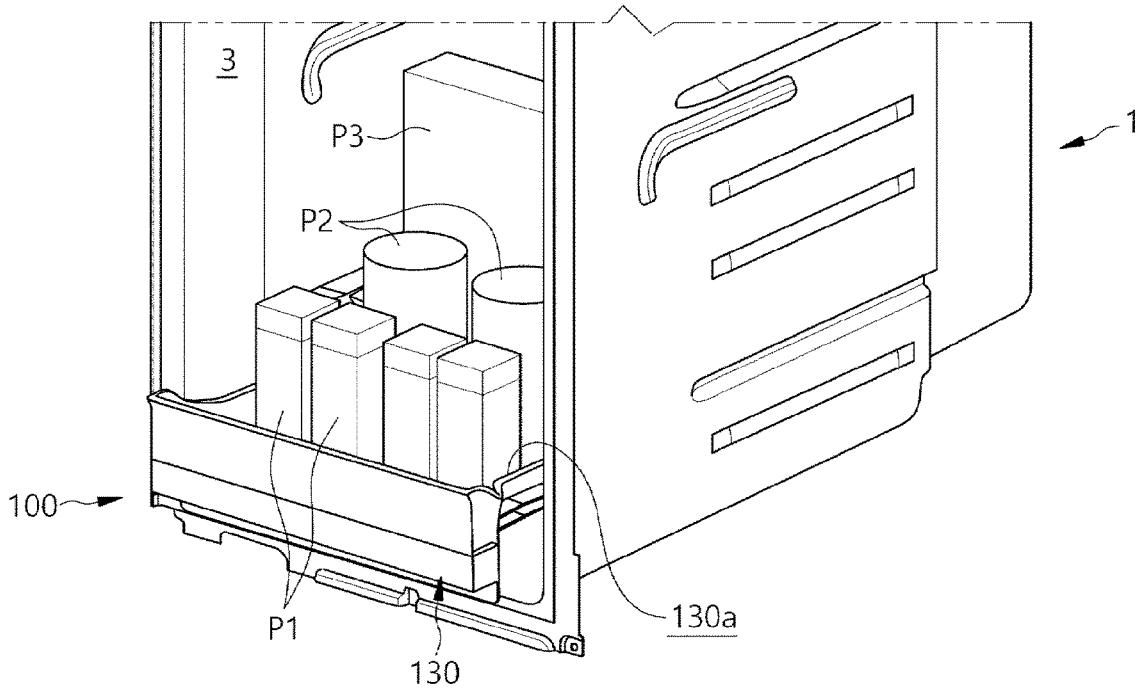

[Fig. 4]
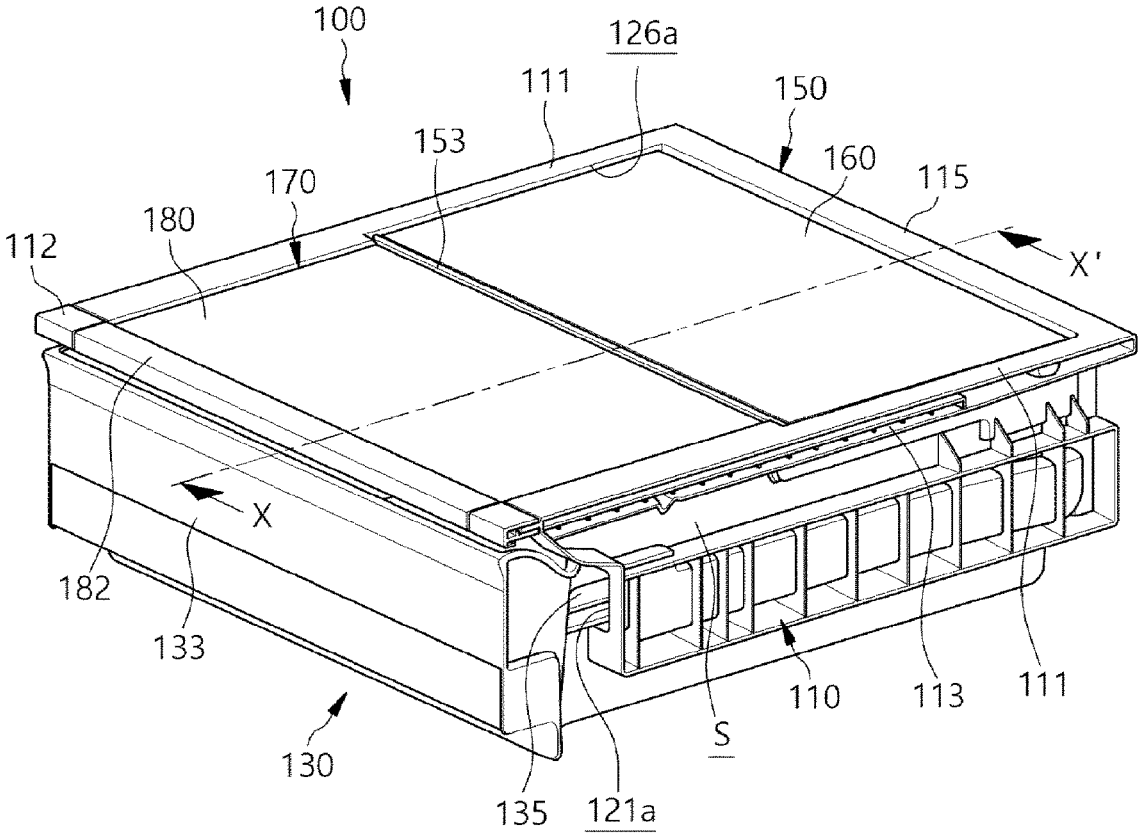
[Fig. 5]
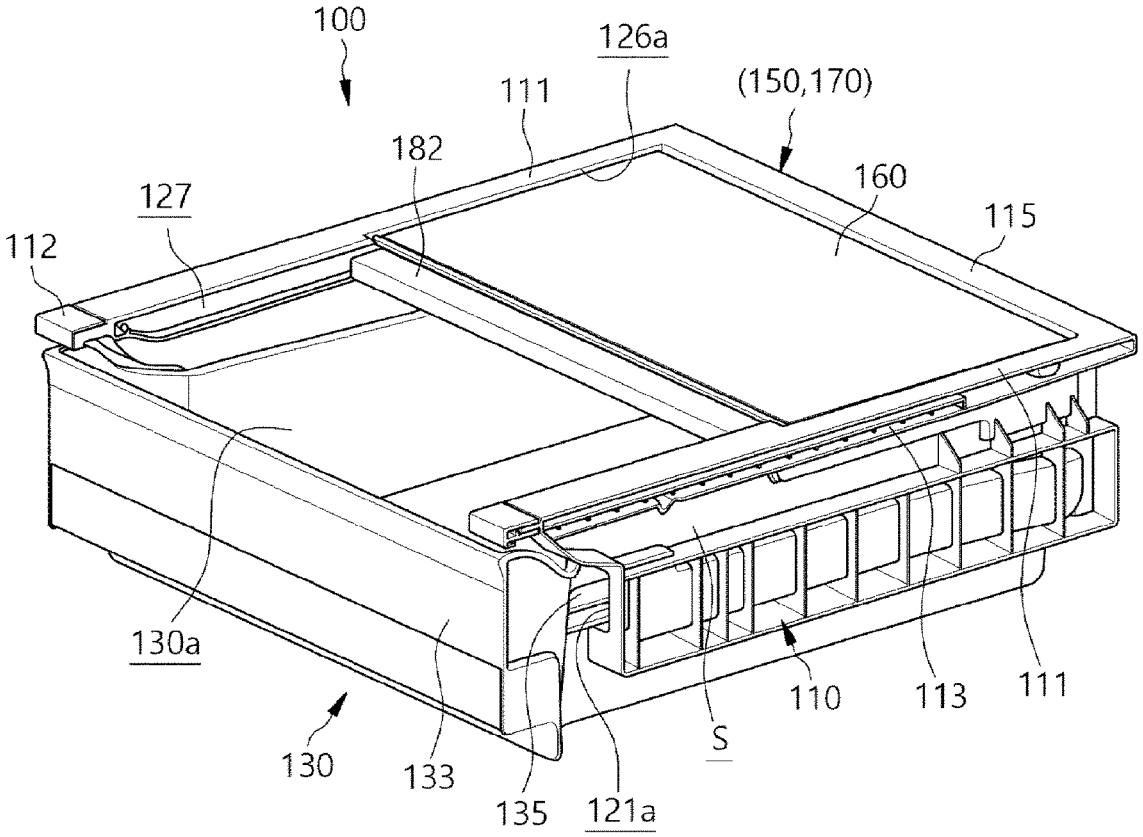

[Fig. 6]
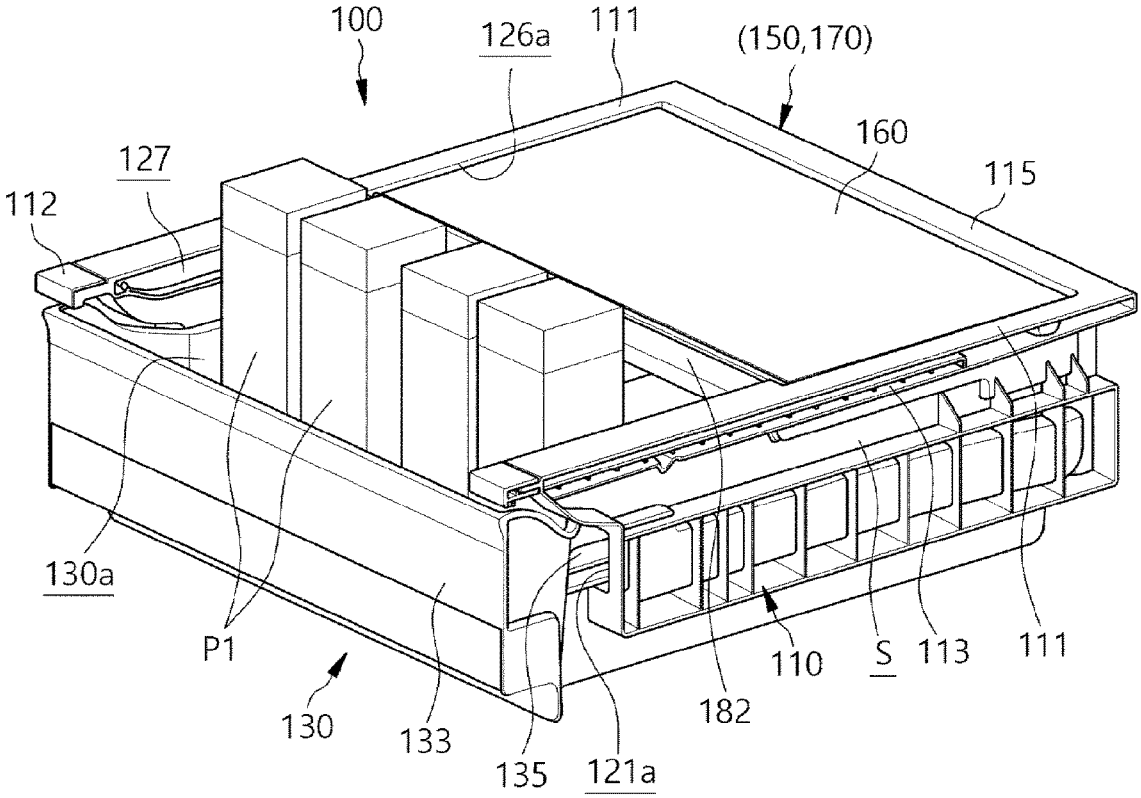
[Fig. 7]
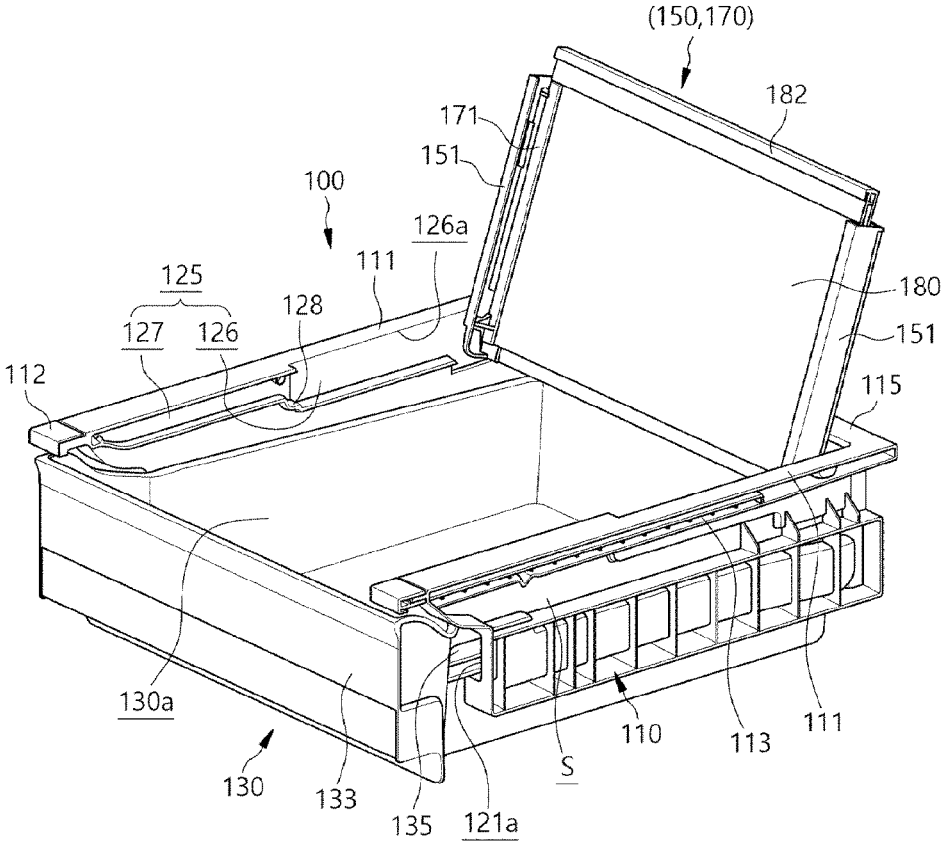

[Fig. 8]
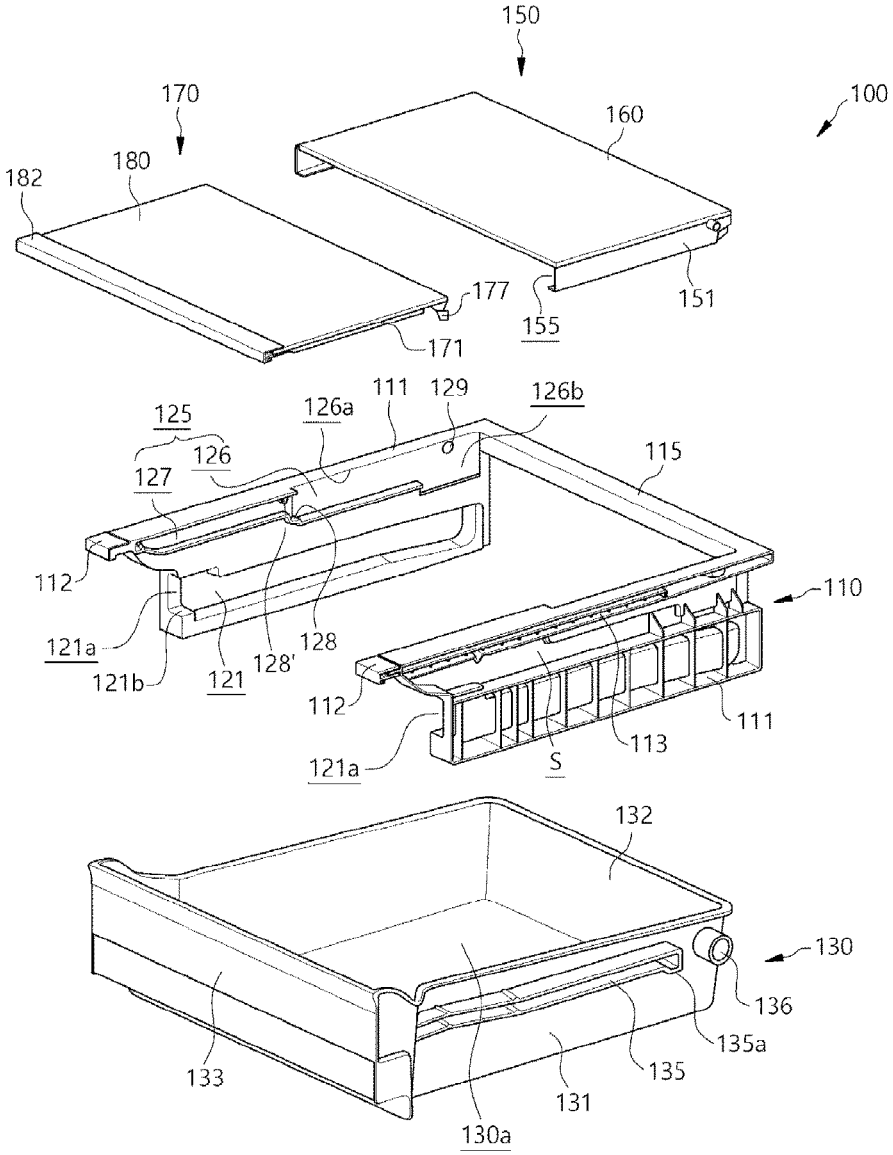

[Fig. 9]
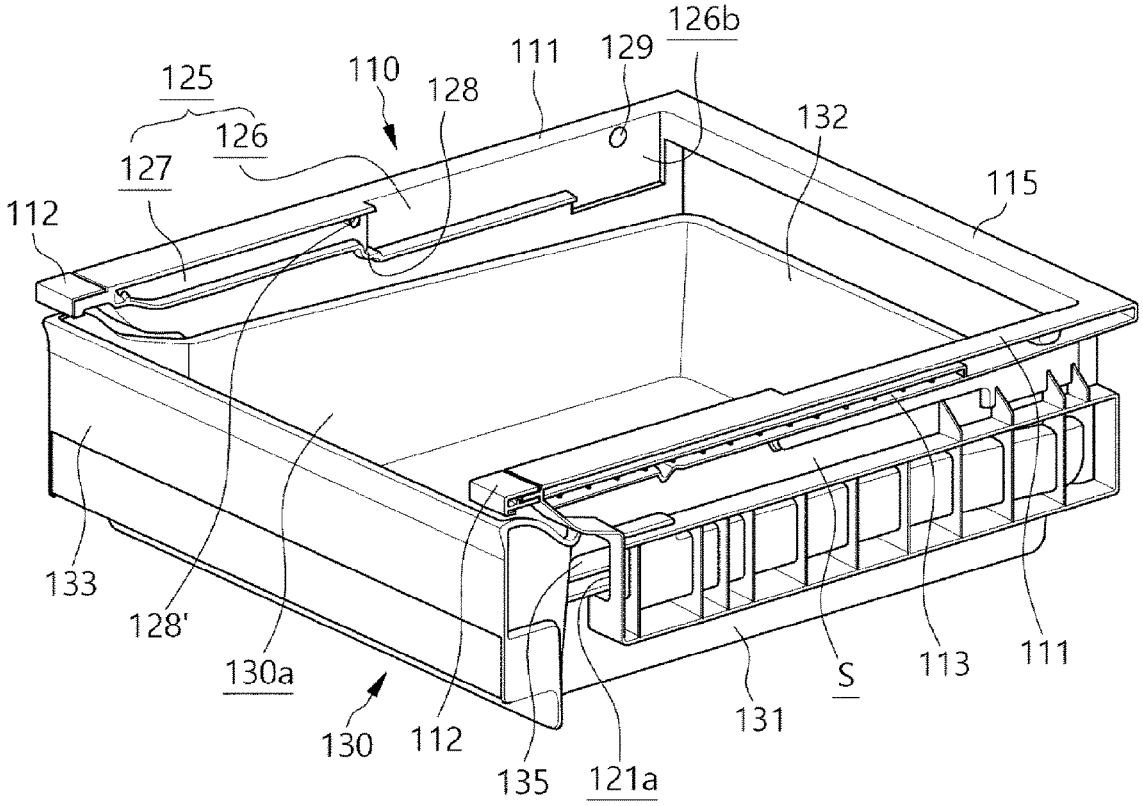
[Fig. 10]
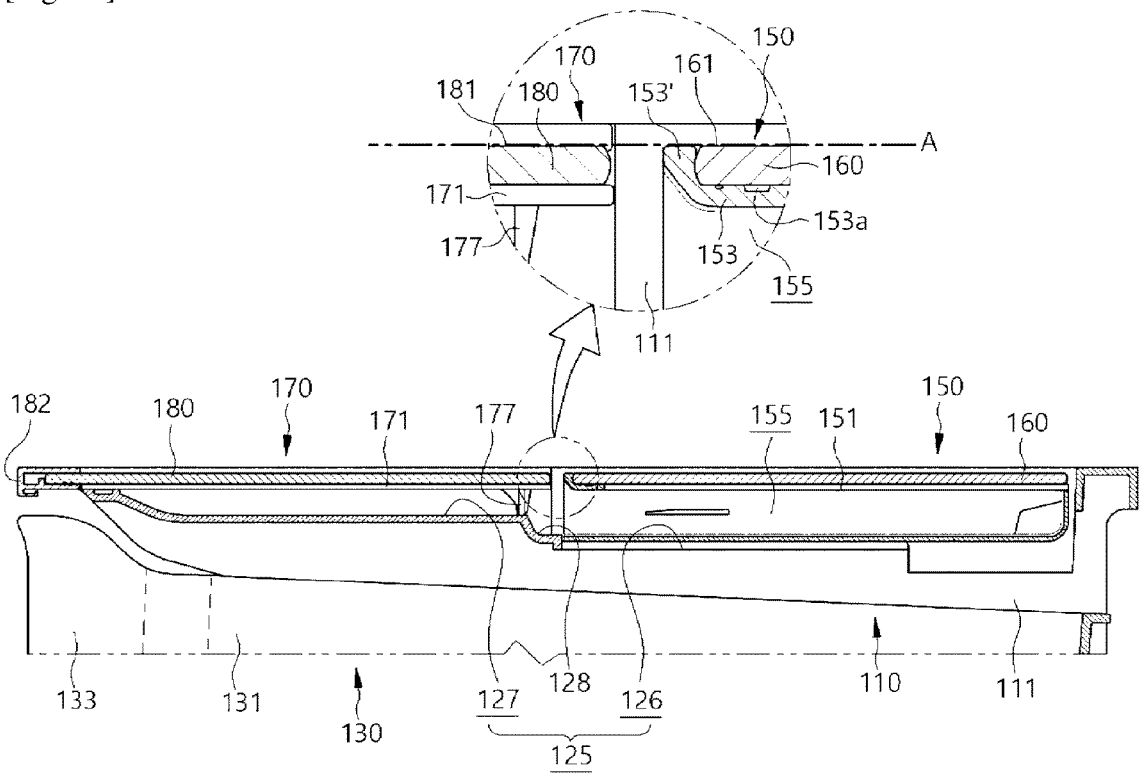

[Fig. 11]
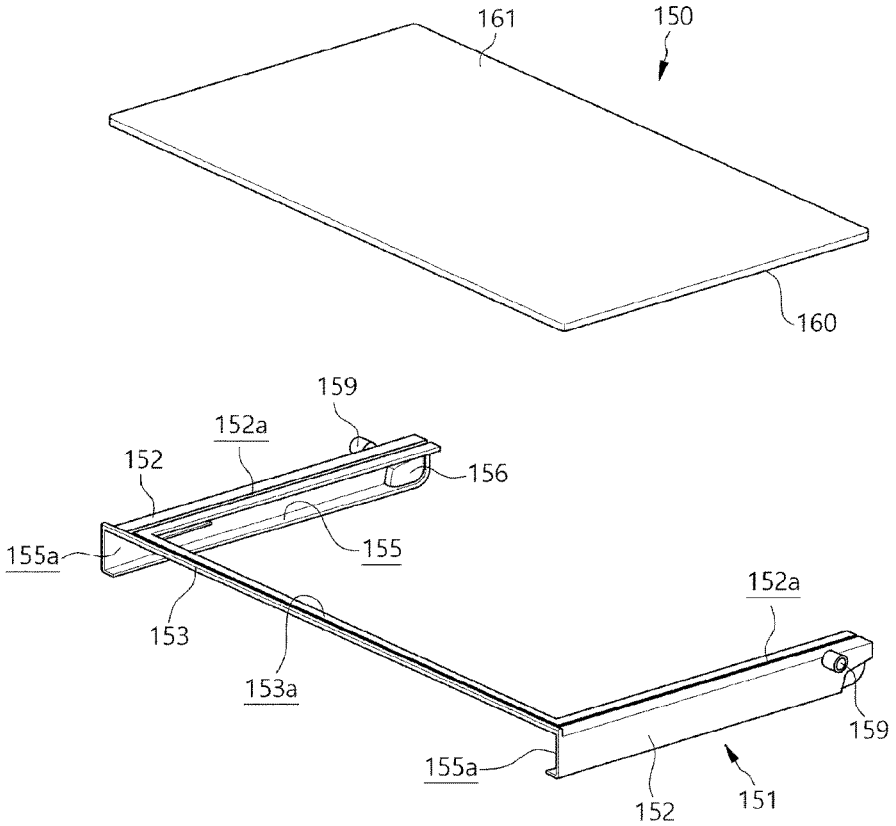
[Fig. 12]
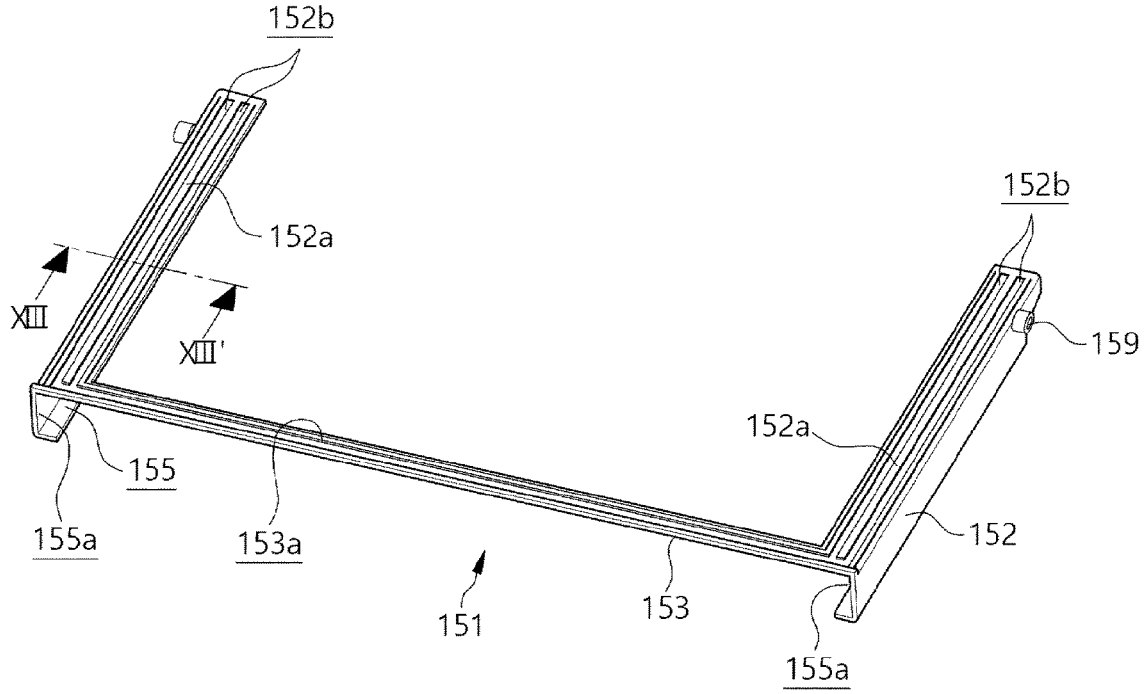

[Fig. 13]
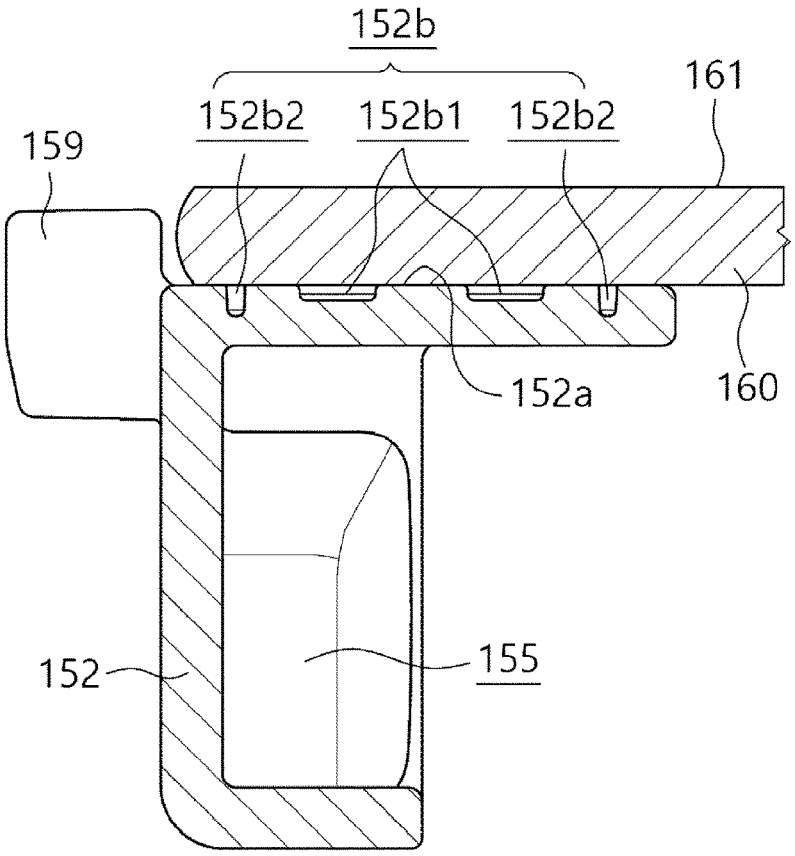
[Fig. 14]
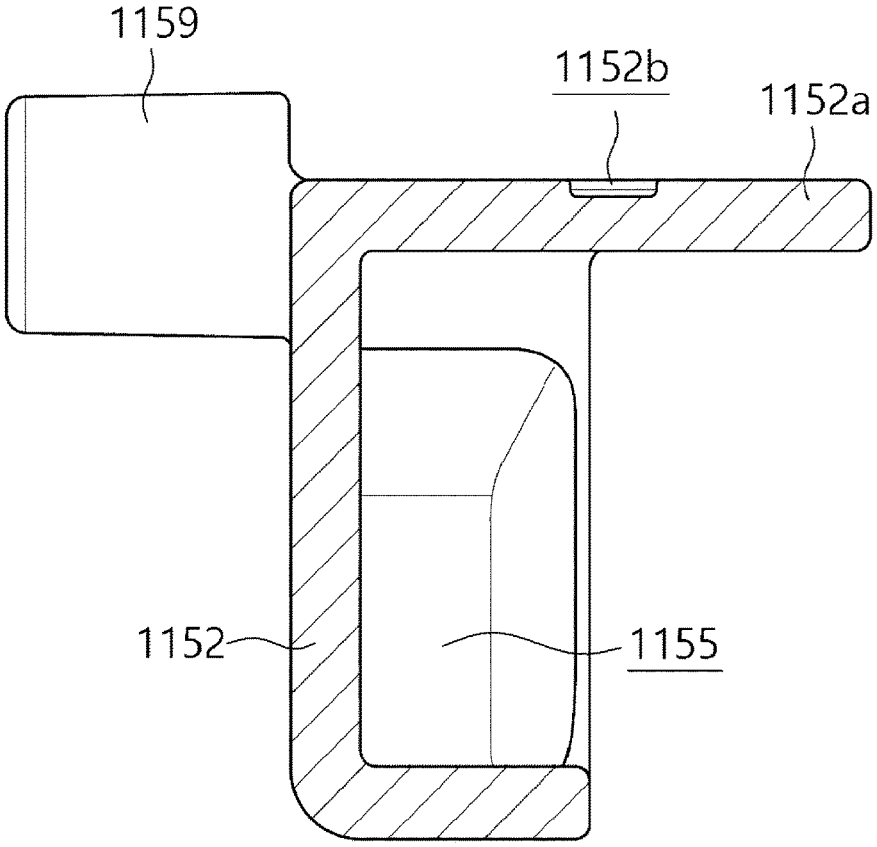

[Fig. 15]
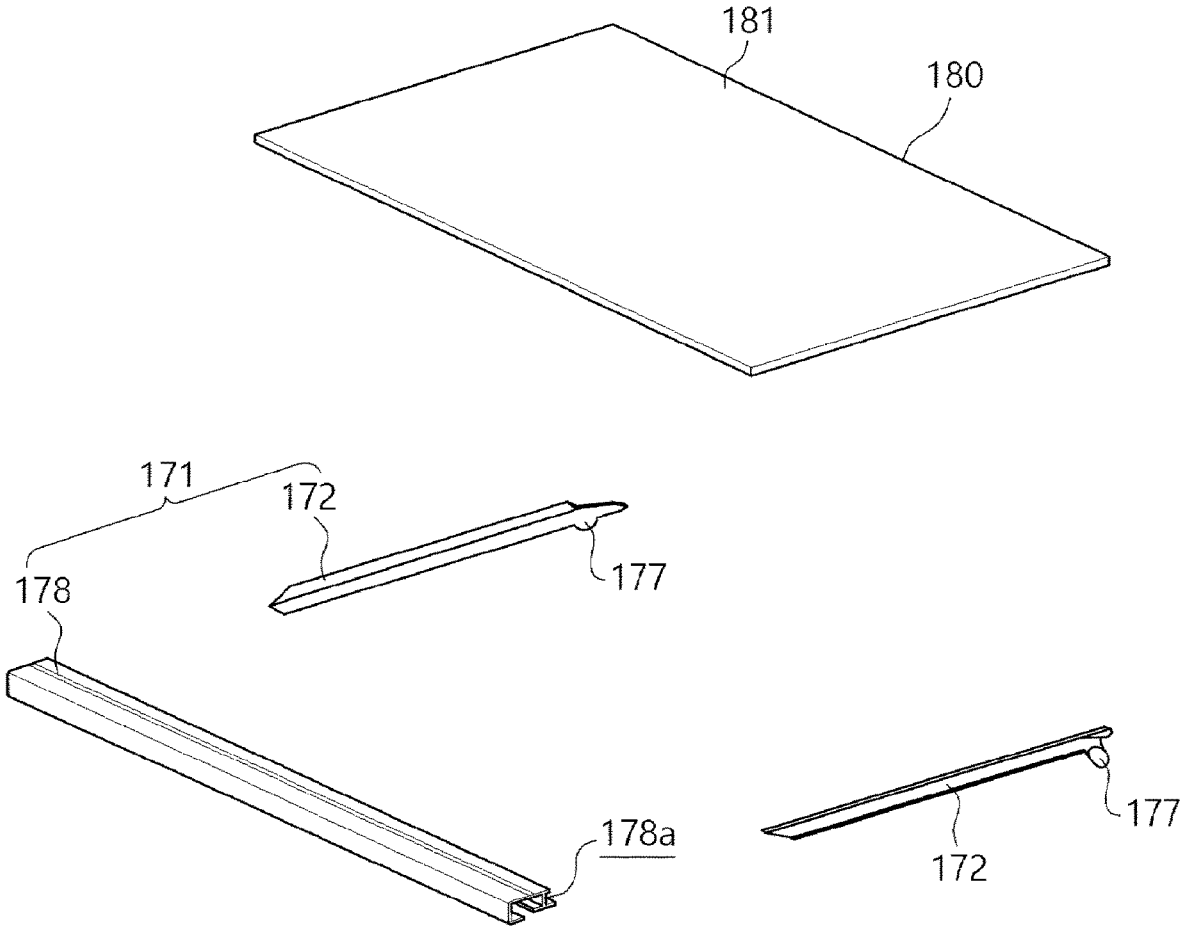

[Fig. 16]
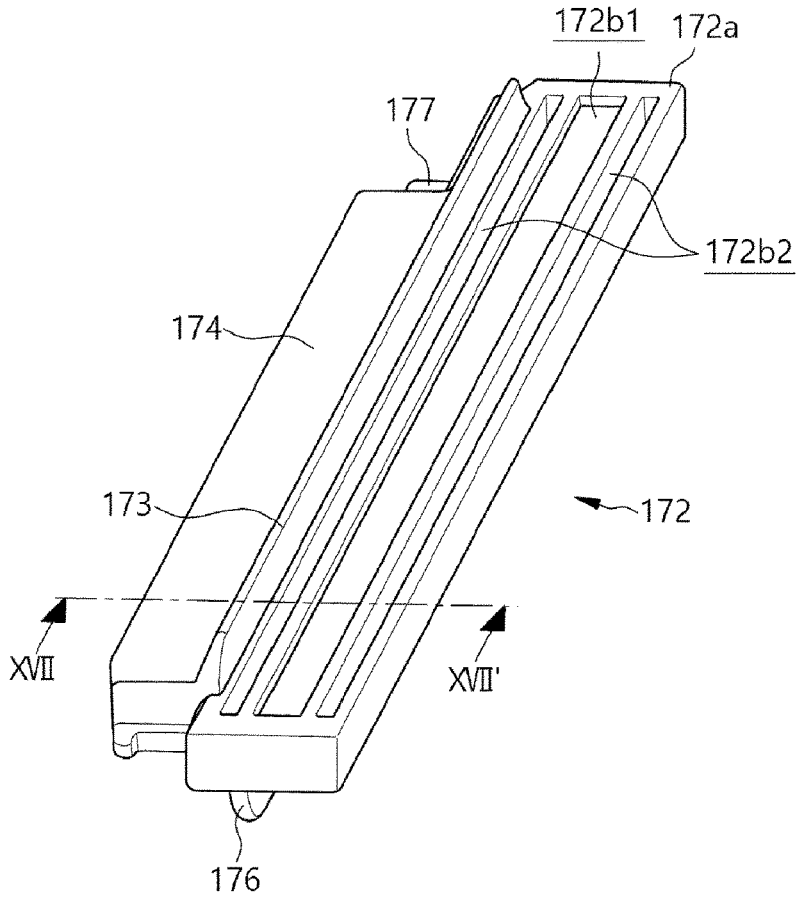
[Fig. 17]
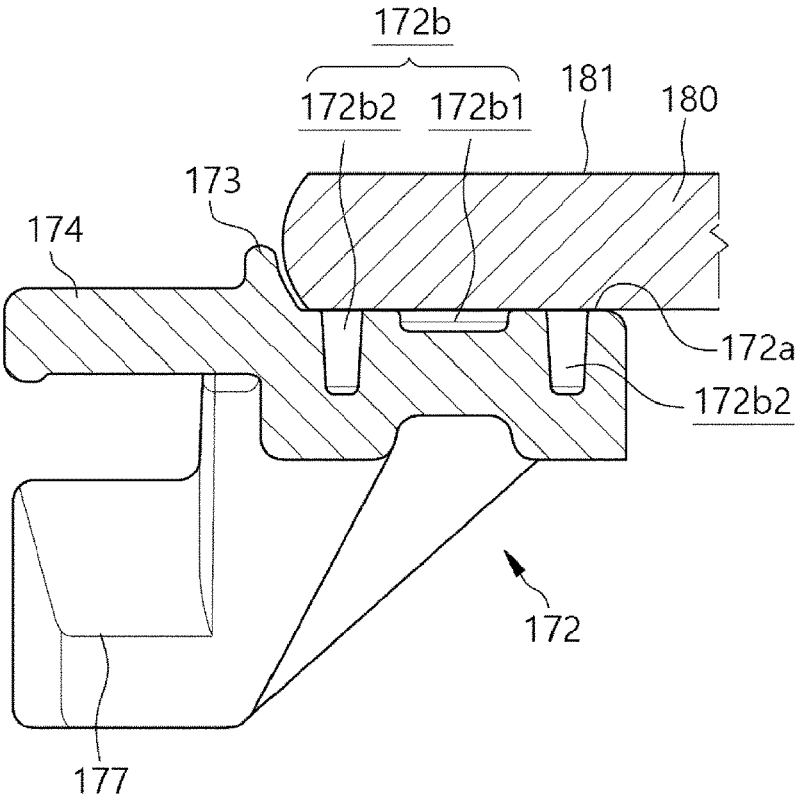

[Fig. 18]
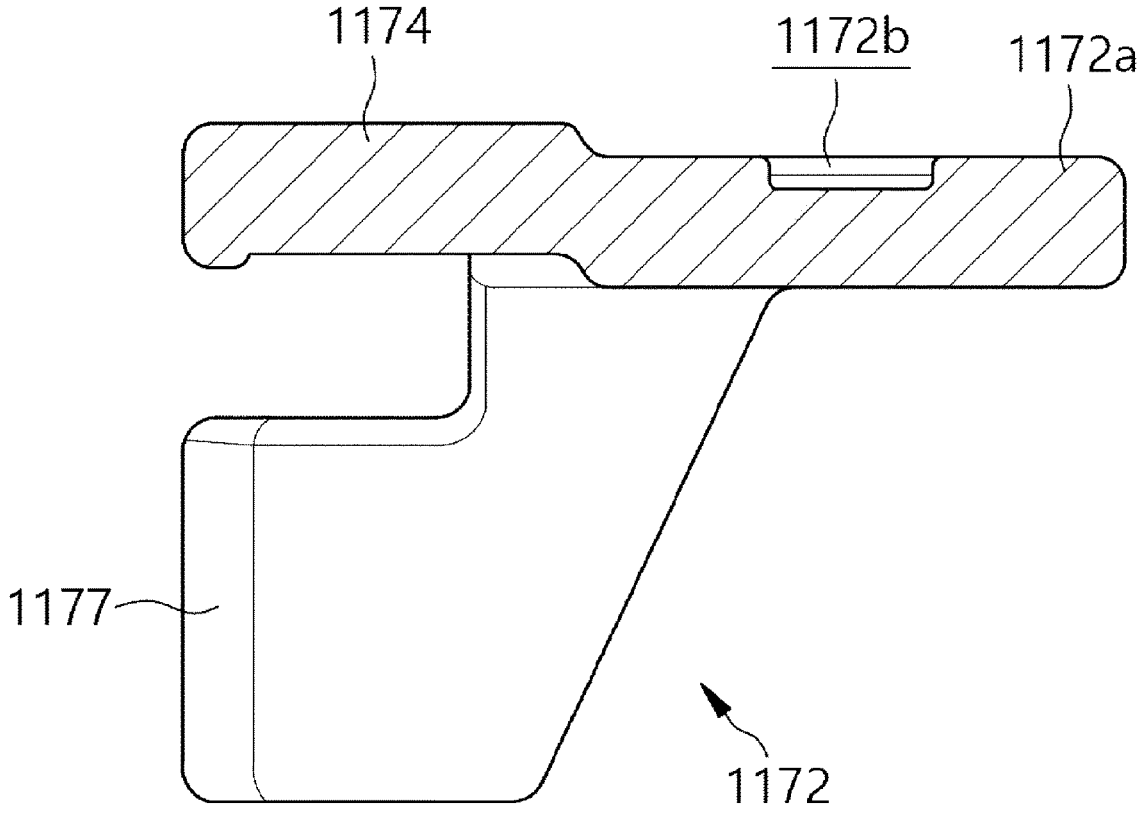

REFRIGERATOR

CROSS REFERENCE TO RELATED APPLICATIONS

This application is the National Phase of PCT International Application No. PCT/KR2022/008325, filed on Jun. 13, 2022, which claims priority under 35 U.S.C. 119 (a) to Patent Application No. 10-2021-0097907, filed in the Republic of Korea on Jul. 26, 2021, and Patent Application No. 10-2021-0097908, filed in the Republic of Korea on Jul. 26, 2021, all of which are hereby expressly incorporated by reference into the present application.

TECHNICAL FIELD

The present disclosure relates generally to a refrigerator and, more particularly, to a refrigerator which has a drawer-type storage assembly provided therein.

BACKGROUND ART

In general, a refrigerator is a home appliance that can store food at a low temperature in an internal storage space which is covered by a refrigerator door. To this end, the refrigerator is configured to store the stored food in an optimal state by cooling the inside of the storage space by using cold air generated through heat exchange with a refrigerant circulating in a refrigeration cycle.

Recently, the refrigerator is gradually becoming larger and multifunctional in accordance with change in dietary life and the trend of high-end products. In addition, for the convenience of a user, various structures are being developed to efficiently use the internal space of the refrigerator. For example, there is a structure in which a storage box for storing fresh food such as fruits is separately placed inside the refrigerator, and the upper part of the storage box is covered by a shelf made of a transparent material such that a user can observe the inside of the storage box. In this case, various products may be placed on the storage box.

The upper shelf of the storage box is made of glass, and a part that secures the edge of the transparent shelf is made of an extruded material. However, in order to cover and fix the edge of the transparent shelf, which is made of glass, with the extruded material, a method such as insert injection is required to be used, thereby increasing manufacturing costs, and a part covered by the extruded material is covered by the extruded material, thereby reducing beauty of the storage box.

Furthermore, when multiple transparent shelves are arranged to extend from each other inside the refrigerator, an extruded material covering the edge of each of the transparent shelves protrudes and thus the upper surfaces of the shelves are not connected in parallel to each other. Accordingly, when items are placed on the upper part of each of the shelves, the items are tilted to one side due to the protruding material, and interfere with other parts during the movement of the shelf.

In order to solve this, a method is developed in which without covering the edge of the transparent shelf with an extruded material, the lower surface of the transparent shelf is adhered to a frame. For example, Korean Patent No. 10-1507411 (Patent Document 1) discloses a technology in which a holding protrusion is provided on the lower part of a glass shelf and adhesive is injected through the inlet of the holding protrusion, and U.S. Pat. No. 4,582,738 (Patent Document 2) discloses a method in which adhesive is injected through a hole of a leg to adhere a glass sheet.

However, according to these prior technologies, in order to inject adhesive into a shelf, an inlet is required to be formed in a frame, and the adhesive is required to be ac-curately injected through the inlet, so manufacturing is not easy. Additionally, in the prior technologies, UV adhesive (light cure adhesive) is used for adhesion of a shelf, and thus a separate UV emission facility is required, thereby increasing manufacturing costs.

In addition, in the process of injecting adhesive, the adhesive may leak between the shelf and the frame, thereby degrading quality of the shelf.

Meanwhile, in the conventional technologies, due to the height of the storage box, the height of items which can be stored on the storage box is limited. That is, only items lower than height between the storage box and a shelf disposed above the storage box can be stored on the storage box.

Furthermore, in order to increase storage height inside a refrigerator, a technology in which the shelf of the refrigerator can be folded has also been disclosed. When the shelf is folded, the height limit due to the shelf is removed, so tall items can be stored inside the refrigerator. For example, Korean Patent No. 10-1410460 (Patent Document 3) and Korean Patent No. 10-0431346 (Patent Document 4) disclose a refrigerator to which a variable shelf which can be rotated is applied.

However, although the shelf of the refrigerator is rotated to be folded, it is difficult to take out items stored inside the refrigerator. Particularly, tall items are more likely to interfere with a shelf placed at the upper side, so it is more difficult to take the tall items out.

DOCUMENTS OF RELATED ART (Patent Document 1) Korean Patent No. 10-1507411
(Patent Document 2) U.S. Pat. No. 4,582,738
(Patent Document 3) Korean Patent No. 10-1410460
(Patent Document 4) Korean Patent No. 10-0431346

DISCLOSURE OF INVENTION

Technical Problem

Accordingly, the present disclosure has been made keeping in mind the above problems occurring in the related art, and the present disclosure is intended to propose a refrigerator in which a depressed adhesive groove is provided in the surface of a shelf frame, and a top plate made of a transparent material is bonded directly to the shelf frame.

The present disclosure is further intended to propose a refrigerator in which a plurality of extended top plates constitutes the same plane and there is no protruding part between the top plates.

The present disclosure is still further intended to propose a refrigerator in which adhesive injected into the adhesive groove is prevented from leaking to the outside of the shelf frame.

The present disclosure is still further intended to propose a refrigerator in which a storage assembly which has variable storage height and can be easily pulled out to the outside is installed.

The present disclosure is still further intended to propose a refrigerator in which the functions of a cover covering a storage space and a shelf are realized with one part.

Solution to Problem

In order to achieve the above objectives, according to one aspect of the present disclosure, a refrigerator of the present disclosure may include a cabinet a storage compartment formed therein, and a storage assembly installed in the storage compartment and having a storage space formed therein. Furthermore, the storage assembly may be provided with a guide frame in which a drawer guide part and a shelf guide part are provided to have different heights, and a storage drawer and a shelf may be disposed in the guide frame.

In this case, the shelf may include a shelf frame coupled to the shelf guide part, and a top plate coupled to an upper surface of the shelf frame, wherein an adhesive part may be depressed in the upper surface of the shelf frame, the adhesive part being open toward the lower surface of the top plate and being filled with adhesive. Accordingly, the shelf frame may not cover the edges of the top plate, and thus the entirety of the upper surface of the top plate may be exposed to the outside, and since adhesive is injected through the adhesive part open upward, the work of injecting the adhesive may be easily performed.

In addition, the shelf may be coupled rotatably to the shelf guide part, and may include a first shelf composed of a first shelf frame, and a first top plate coupled to the upper part of the first shelf frame. Additionally, the shelf may further include a second shelf moving along the shelf guide part and the first shelf frame, wherein the second shelf may include a second top plate coupled to the upper part of a second shelf frame. A first adhesive part and a second adhesive part may be depressed respectively in the upper surfaces of the first shelf frame and the second shelf frame, the first adhesive part and the second adhesive part being open toward the lower surfaces of the first top plate and the second top plate, respectively.

Furthermore, the first adhesive part may include a side adhesive groove formed in the upper surface of each of a pair of first shelf bodies disposed at opposite sides of the first shelf frame, and a front adhesive groove formed in the upper surface of a first front body disposed on the front of the first shelf frame.

Additionally, the side adhesive groove may include a first side adhesive groove extending along the longitudinal direction of each of the pair of first shelf bodies, and formed in parallel with the first side adhesive groove and a second side adhesive groove disposed at a more outer side than the first side adhesive groove.

In addition, the second side adhesive groove may be disposed at each of opposite sides of the first side adhesive groove.

Furthermore, the first side adhesive groove may be configured to be wider in a left-to-right width than the second side adhesive groove, and the second side adhesive groove may be configured to be deeper in a depressed depth than the first side adhesive groove.

Additionally, the first shelf frame may include the pair of first shelf bodies disposed at opposite sides thereof by being spaced apart from each other. The first front body may be located between the pair of first shelf bodies to connect the pair of first shelf bodies to each other, the first front body being disposed on the front of the first shelf frame. In this case, the adhesive part may be continuously formed in the upper surfaces of the first shelf bodies and the upper surface of the first front body.

In addition, connecting guide parts may be formed in the pair of first shelf bodies, respectively, to face each other, and the second shelf may slide forward and rearward along the shelf guide part and each of the connecting guide parts, and when the second shelf moves from the shelf guide part to the connecting guide part, the second shelf may overlap the first shelf.

In addition, the second adhesive part may include a main adhesive groove extending along the longitudinal direction of a second shelf body disposed on each of opposite sides of the second shelf frame. Additionally, an auxiliary adhesive groove may be formed in parallel with the main adhesive groove, and the auxiliary adhesive groove may be disposed at a more outer side than the main adhesive groove.

Furthermore, the main adhesive groove may be configured to be wider in a left-to-right width than the auxiliary adhesive groove, and the auxiliary adhesive groove may be configured to be deeper in a depressed depth than the main adhesive groove.

Additionally, a guide fence may protrude on the upper surface of the second shelf body and may extend in a direction parallel with the second adhesive part. In this case, the guide fence may cover the peripheral surface of the second top plate, and may be disposed closer to the outside of the first shelf body than the auxiliary adhesive groove.

Additionally, a cover part may be provided on the first front body so as to cover the peripheral surface of the front of the first top plate, and when the second shelf is extended from the first shelf, the upper surface of the first shelf, the upper surface of the second shelf, and the upper surface of the cover part may constitute the same plane.

The refrigerator of the present disclosure may include the cabinet having the storage compartment formed therein, and the storage assembly installed in the storage compartment and having the storage space defined therein. Furthermore, the storage assembly may include the guide frame provided with the drawer guide part and the shelf guide part provided by having heights different from each other. The storage drawer may move along the drawer guide part, and the first shelf and the second shelf which cover the storage space may be disposed on the upper part of the storage drawer.

In this case, when the second shelf moves along the connecting guide part of the first shelf, the second shelf may overlap the first shelf, and the first shelf and the second shelf overlapping each other may rotate together. Accordingly, a user may store tall items in the storage space, and may pull out the storage drawer forward to such that items can be taken out without interfering with other parts inside the refrigerator.

In addition, a moving rail of the storage drawer may be coupled to the drawer guide part, and a shelf rail of the second shelf may be coupled to the shelf guide part.

Furthermore, the drawer guide part and the shelf guide part may be provided on the same surface of the guide frame, and the drawer guide part may be provided at a position lower than the shelf guide part. Accordingly, all of the storage drawer and the two shelves may be disposed in the one guide frame.

Additionally, the shelf guide part may include a first shelf guide with which the first shelf is assembled, and a second shelf guide connected to the first shelf guide. The first shelf guide may be configured to be larger in a vertical width than the second shelf guide, and thus a step part may be formed between the first shelf guide and the second shelf guide.

In addition, a rotation recess into which a rotating protrusion part of the first shelf is inserted may be recessed in the first shelf guide.

Furthermore, the front of the connecting guide part directed toward the second shelf may be open, and a guide protrusion part inserted into the connecting guide part may protrude on the side surface of the second shelf.

Additionally, when the second shelf is extended from the first shelf, the upper surface of the first shelf and the upper surface of the second shelf may constitute the same plane.

In addition, the upper part of the first shelf guide may be open upward, and each of the first shelf and the second shelf may be assembled with the guide frame through the upper part of the first shelf guide.

Furthermore, the guide frame may include a pair of side bodies disposed to be spaced apart from each other, each of the side bodies having the first shelf guide and the second shelf guide, and a rear body whose opposite ends are connected to the pair of side bodies, respectively.

Meanwhile, the first shelf may include the pair of first shelf bodies coupled to the pair of side bodies, respectively, and the first front body facing the rear end part of the second shelf. Additionally, the first shelf may further include the first top plate seated on the upper surface of the first shelf body and the upper surface of the first front body.

In addition, the second shelf may include the pair of second shelf bodies coupled to the pair of side bodies, respectively, and a second front body disposed in front of the pair of second shelf bodies. In this case, the second top plate may be seated on the upper surface of the second shelf body and the upper surface of the second front body, and when the second shelf body moves from the second shelf guide of the side body to the connecting guide part of the first shelf, the second top plate may be disposed under the first top plate to overlap the first top plate.

Advantageous Effects of Invention

As described above, the refrigerator of the present disclosure may have the following effects.

In the refrigerator of the present disclosure, an adhesive part may be depressed in the surface of a shelf frame constituting a shelf, and the top plate made of a transparent material may be bonded directly to the shelf frame by covering the adhesive part. Accordingly, the shelf frame may not cover the edge of the top plate, and the entirety of the upper surface of the top plate, thereby improving the beauty of the shelf.

In this case, adhesive may be injected through the adhesive part open upward into the shelf frame without an inlet having a complicated structure, thereby facilitating the work of injecting adhesive.

In addition, an extruded material may not protrude between the first shelf and the second shelf which are extended, and the upper surfaces of the shelves may constitute the same plane. Accordingly, even if items are placed on the shelves, the items may not tilt, and when moving the items, there is no part interfering with the items, thereby improving the usability of the refrigerator.

Furthermore, in the shelf of the refrigerator of the present disclosure, multiple adhesive grooves may be disposed in parallel with each other along the longitudinal direction of a shelf body. Adhesive supplied to the upper surface of the shelf frame may be injected into multiple adhesive grooves, thereby increasing adhesive force between the shelf frame and the top plate. Additionally, adhesive may be sequentially injected into the multiple adhesive grooves, and thus the adhesive may be prevented from leaking to the outside of the shelf frame. Accordingly, the assembly quality of the shelf of the refrigerator may be improved, and the beauty of the shelf may also be improved.

In addition, the adhesive part formed in the shelf frame may be configured as a structure which is depressed in the upper surface without penetrating the shelf frame. Accordingly, the structure of a mold for injection molding the shelf frame may be made simpler, thereby reducing manufacturing costs.

Meanwhile, in the refrigerator of the present disclosure, when the first shelf and the second shelf functioning as the cover of the storage assembly overlap each other, the storage space may be open upward to increase storage height at which items can be stored. Simultaneously, the storage drawer provided with the storage space may be pulled out forward. Accordingly, a user may store tall items, and may pull out the storage drawer forward such that items are taken out without interfering with other parts in the refrigerator, thereby improving usability.

Furthermore, when the second shelf is extended from the first shelf, the first shelf and the second shelf may cover the upper part of the storage space to function as a cover, and simultaneously, may function as a shelf to place items on. Accordingly, a user may use the storage assembly for various purposes, thereby increasing the utility of the storage assembly.

Particularly, a user may (i) extend the second shelf from the first shelf such that the first shelf and the second shelf are used as a cover and a shelf, (ii) allow the second shelf to overlap the first shelf to open only the front part of the storage drawer upward, (iii) fold the second shelf and the first shelf overlapping each other to open all of the front and rear parts of the storage drawer. Accordingly, a user may variously modify the storage assembly according to his or her usage environment thereof, thereby increasing the degree of freedom to utilize the storage assembly.

In addition, in the refrigerator of the present disclosure, the first shelf and the second shelf may operate independently of the storage drawer. While the first shelf and the second shelf stay in the refrigerator and perform the function of a shelf, a user may pull out only the storage drawer to take out or store items. Accordingly, a cover to cover the storage space and a shelf to place items on are not required to be separately provided, thereby decreasing the number of parts of the storage assembly and simplifying the structure thereof.

BRIEF DESCRIPTION OF DRAWINGS

FIG. 1 is a perspective view illustrating an embodiment of a refrigerator of the present disclosure.

FIG. 2 is a perspective view illustrating a state in which items are stored in a storage assembly constituting the refrigerator of FIG. 1 according to the embodiment.

FIG. 3 is a perspective view illustrating a state in which a storage drawer is pulled out from the storage assembly illustrated in FIG. 2.

FIG. 4 is a perspective view illustrating the configuration of the storage assembly constituting the refrigerator of FIG. 1 according to the embodiment.

FIG. 5 is a perspective view illustrating a state in which a second cover overlaps a first cover in the storage assembly constituting the refrigerator of FIG. 1 according to the embodiment.

FIG. 6 is a perspective view illustrating a state in which items are stored in a storage space in the state illustrated in FIG. 5.

FIG. 7 is a perspective view illustrating a state in which the first cover and the second cover are folded in the storage assembly constituting the refrigerator of FIG. 1 according to the embodiment.

FIG. 8 is an exploded perspective view illustrating each part of the storage assembly constituting the refrigerator of FIG. 1 according to the embodiment.

FIG. 9 is a perspective view illustrating a state in which a guide frame and the storage drawer of the storage assembly constituting the refrigerator of FIG. 1 are assembled with each other according to the embodiment.

FIG. 10 is a sectional view taken along line X-X' of FIG. 4.

FIG. 11 is an exploded perspective view illustrating the configuration of the first shelf constituting the refrigerator of FIG. 1 according to the embodiment.

FIG. 12 is a perspective view illustrating the configuration of a first shelf frame illustrated in FIG. 11.

FIG. 13 is a sectional view taken along line XIII-XIII' of FIG. 12.

FIG. 14 is a sectional view illustrating the configuration of a first shelf frame according to another embodiment.

FIG. 15 is an exploded perspective view illustrating the configuration of a second shelf constituting the refrigerator according to the embodiment of FIG. 1.

FIG. 16 is a perspective view illustrating the configuration of a second shelf body of a second shelf frame illustrated in FIG. 15.

FIG. 17 is a sectional view taken along line XVII-XVII' of FIG. 16.

FIG. 18 is a sectional view illustrating the configuration of a second shelf frame according to the another embodiment.

MODE FOR THE INVENTION

Hereinafter, some embodiments of the present disclosure will be described in detail with reference to exemplary drawings. In adding reference numerals to the components of each drawing, it should be noted that the same components are given the same reference numerals as much as possible even though they are indicated on different drawings. In addition, in describing the embodiments of the present disclosure, when it is determined that a detailed description of a related known configuration or function interferes with an understanding of the embodiments of the present disclosure, a detailed description thereof will be omitted.

The present disclosure relates to a refrigerator, and a storage assembly 100 is disposed inside the refrigerator. The storage assembly 100 is intended to store food and other objects (hereinafter, referred to as "items P1, P2, and P3"). A part (a storage drawer 130) of the storage assembly 100 may be moved in and out of a storage compartment 3 of the refrigerator, and other parts (a first shelf 150 and a second shelf 170) of the storage assembly 100 may overlap each other or be folded in the storage compartment 3. Hereinbelow, the structure of the storage assembly 100 will be mainly described.

Prior to description, the direction of the drawing will be defined. The front of the refrigerator faces a user when the user looks at the refrigerator in front of the refrigerator, and the rear of the refrigerator is a side opposite to the front (see an X-axis direction of FIG. 1). In addition, the left and right of the refrigerator are disposed in the left-to-right width direction of the refrigerator (see a Y-axis direction of FIG. 1), and the upper and lower sides of the refrigerator are disposed in the height direction (see a Z-axis direction of FIG. 1) of the refrigerator.

The refrigerator may include a cabinet having the storage compartment 3 provided therein, and a refrigerator door (not shown) which is coupled to the cabinet and covers the storage compartment 3. The cabinet may be configured as a casing open forward, and FIG. 1 illustrates an inner casing 1 constituting the cabinet. Although not shown, the cabinet may include an outer casing constituting the outer wall of the cabinet, and the inner casing 1 constituting the inner wall of the cabinet.

The storage compartment 3 may be provided in the inner casing 1. The storage compartment 3 is an empty space in which objects are stored, and may be provided with multiple shelves (not shown). The shelves are may function to divide the storage compartment 3 in a vertical direction. In order to install the shelves, mounting rails 5 may be provided on the inner surface of the storage compartment 3.

The storage compartment 3 may be provided with the storage assembly 100. The storage assembly 100 may store items P1, P2, and P3 in a storage space 130*a* defined therein, and may also provide the function of a shelf on which the items P1, P2, and P3 can be seated. The storage assembly 100 may be disposed in the storage compartment 3, and specifically, as shown in FIG. 1, may be disposed on the bottom part of the storage compartment 3, but may be disposed at the middle or upper side of the storage compartment 3.

Referring to FIGS. 2 and 3, it can be seen that the storage drawer 130 among parts constituting the storage assembly 100 is moved in and out of the storage compartment 3. In FIG. 2, the storage drawer 130 is located inside the storage compartment 3, and in FIG. 3, the storage drawer 130 is moved out of the storage compartment 3. As shown in FIG. 3, after pulling out the storage drawer 130, a user may store items P1, P2, and P3 in the storage space 130*a* or may take out items P1, P2, and P3 stored in the storage space 130*a*.

In FIGS. 2 and 3, the storage space 130*a* of the storage drawer 130 is illustrated to be open upward. That is, the shelves 150 and 170 covering the upper side of the storage drawer 130 may overlap each other or rotate by overlapping each other to open the storage space 130*a*. When the storage space 130*a* is open, tall items P1, P2, and P3 may be stored in the storage space 130*a*.

Here, a state in which the first shelf 150 and the second shelf 170 constituting the shelves 150 and 170 overlap each other indicates the state of the first shelf 150 and the second shelf 170 illustrated in FIG. 5, and a state in which the first shelf 150 and the second shelf 170 overlapped each other are rotated indicates the state of the first shelf 150 and the second shelf 170 illustrated in FIG. 7. Additionally, a state in which the second shelf 170 is extended from the first shelf 150 indicates the state in which the upper side of the storage space 130*a* is covered by the first shelf 150 and the second shelf 170 as illustrated in FIG. 4.

Accordingly, a user may (i) extend the second shelf 170 from the first shelf 150 to be used as a cover and a shelf as illustrated in FIG. 4, (ii) allow the second shelf 170 to overlap the first shelf 150 to open only the front part of the storage drawer 130 upward as illustrated in FIG. 5, and (iii) fold the second shelf 170 and the first shelf 150 overlapping each other to open both the front and rear parts of the storage drawer 130 as illustrated in FIG. 7. Among these, in FIGS. 5 and 7, the storage space 130*a* is open upward, and thus may store items P1, P2, and P3 higher than the height of the storage space 130*a*.

The storage assembly 100 may be disposed in the storage compartment 3, and the position of the storage assembly 100 may be determined by a guide frame 110. The guide frame 110 may be fastened to the inner casing 1 and may guide the forward and rearward movements of the storage drawer 130.

In addition, the guide frame 110 may guide the rotation of the first shelf 150 and the forward and rearward movements of the second shelf 170. The guide frame 110 may be fastened to the inner casing 1 by a fastener such as a screw, or may be fastened thereto by press-fitting or adhering.

Referring to FIGS. 7 and 8, the guide frame 110 may have an approximately U-shaped frame. More precisely, the guide frame 110 may include a pair of side bodies 111 disposed in parallel to each other by being spaced apart from each other, and a rear body 115 connecting the pair of side bodies 111 to each other. The guide frame 110 may be made of a synthetic resin material and may be integrally molded.

The pair of side bodies 111 of the guide frame 110 may respectively be in close contact with opposite side surfaces of the inner surface of the inner casing 1, and the rear body 115 may be in close contact with the rear surface of the inner surface of the inner casing 1. The guide frame 110 may be securely fastened to the inner casing 1 such that the guide frame 110 is not moved together with the storage drawer 130 in the process of the moving in and out of the storage drawer 130.

Each of the side bodies 111 of the guide frame 110 may have a shape of an approximately quadrangular plate. Multiple reinforcing ribs (a reference number omitted) may be provided on the outer surface of the side body 111 facing the inner surface of the inner casing 1. The reinforcing ribs may not extend up to the upper surface of the guide frame 110, but stop before the upper surface.

In addition, a deformation prevention part 113 may be provided on the upper part of the side body 111. The deformation prevention part 113 may be provided in a front-to-rear direction along the upper end of the side body 111, and may be a kind of slimming structure. The deformation prevention part 113 is intended to prevent the side body 111 from shrinking due to thermal deformation when the guide frame 110 is injection molded. Reference number 112 indicates a front decoration provided on the front end of the deformation prevention part 113, and the front decoration 112 may provide beauty unified with a second front body 178 of the second shelf 170 to be described below.

A mounting groove S may be formed between the reinforcing ribs and the deformation prevention part 113. The mounting groove S may be a part depressed more than the deformation prevention part 113 and the reinforcing ribs. A mounting part (not shown) of the inner casing 1 may be fitted into the mounting groove S such that the guide frame can be fixed to the inner casing 1.

A drawer guide part 121 and a shelf guide part 125 having different heights may be provided on the inner surface of the side body 111. The drawer guide part 121 may guide the storage drawer 130, and the shelf guide part 125 may guide the first shelf 150 and the second shelf 170. Each of the drawer guide part 121 and the shelf guide part 125 may extend in a front-to-rear direction which is the longitudinal direction of the side body 111.

In the embodiment, the drawer guide part 121 may be disposed at a side lower than the shelf guide part 125. Accordingly, the storage drawer 130 may be disposed under the first shelf 150 and the second shelf 170, and the first shelf 150 and the second shelf 170 may function as the cover of the storage drawer 130.

As illustrated in FIG. 8, the drawer guide part 121 may extend in the front-to-rear direction and may be configured to be recessed in the side body 111. A moving rail 135 of the storage drawer 130 may be fitted to the drawer guide part 121, and when the storage drawer 130 is moved out forward and moved in rearward, the moving rail 135 may be guided by the drawer guide part 121.

The front end part of the drawer guide part 121 may be open forward to form a rail entrance 121*a*. The moving rail 135 may be fitted through the rail entrance 121*a* into the drawer guide part 121. The rail entrance 121*a* may have a rail stopper 121*b* formed by protruding therefrom, and the rail stopper 121*b* may hold a rail end part 135*a* of the moving rail 135 and may prevent the storage drawer 130 from completely being removed from the guide frame 110.

Looking at the shelf guide part 125, the shelf guide part 125 may include a first shelf guide 126 disposed at a relatively inner side of the side body 111, and a second shelf guide 127 disposed at a relatively outer side thereof. The first shelf 150 may be disposed in the first shelf guide 126, and the second shelf 170 may be disposed in the second shelf guide 127. The first shelf guide 126 and the second shelf guide 127 may be continuously connected to each other to form one path.

The first shelf guide 126 may have greater in a vertical width than the second shelf guide 127. Referring to FIG. 5, the first shelf 150 and the second shelf 170 to overlap the first shelf 150 may be disposed in the first shelf guide 126, so the first shelf guide 126 may be greater in the vertical width than the second shelf guide 127.

A step part 128 may be formed between the first shelf guide 126 and the second shelf guide 127. Since the first shelf guide 126 is larger in width than the second shelf guide 127, the step part 128 having the shape of a kind of step may be formed therebetween. In the embodiment, the step part 128 may extend in an inclined direction. Accordingly, when the second shelf 170 moves from the second shelf guide 127 toward the first shelf guide 126, the rear end part of the second shelf 170 may naturally be inclined downward.

More precisely, a guide protrusion part 177 provided on the second shelf 170 may move downward on the step part 128, and accordingly, the entirety of the second shelf 170 may move in the inclined direction. When the guide protrusion part 177 of the second shelf 170 moves downward on the step part 128, the entirety of the second shelf 170 may be inclined, and in this state, the second shelf 170 may move to the lower side of the first shelf 150 and thus the first shelf 150 and the second shelf 170 may stacked on each other.

In this case, as illustrated in FIG. 8, a shelf stopper 128' may be provided between the first shelf guide 126 and the second shelf guide 127 at a side opposite to the step part 128. The shelf stopper 128' may interfere with the guide protrusion part 177 so as to fix the initial position of the guide protrusion part 177. When the second shelf 170 is extended again from the first shelf 150 (see FIG. 4), the guide protrusion part 177 may interfere with the shelf stopper 128'. Accordingly, the guide protrusion part 177 may be located behind the shelf stopper 128'.

Meanwhile, in the embodiment, the first shelf guide 126 may be deeper even in a recessed depth than the second shelf guide 127. That is, relative to the left-to-right width direction (the Y-axis direction of FIG. 1), the first shelf guide 126 may be recessed more to the inside of the side body 111 than the second shelf guide 127. In this case, a first shelf body 152 of the first shelf 150 may be located in the first shelf guide 126, and a connecting guide part 155 of the first shelf body 152 may be continuously connected to the second shelf guide 127.

Referring to FIG. 7, the upper part of the first shelf guide 126 may be open upward, and an opening part 126*a* may be formed on the upper end of the side body 111. The opening part 126*a* may be formed in a direction in which the left-to-right width of the storage space 130*a* is further increased. The first shelf 150 and the second shelf 170 may be mounted to the guide frame 110 by being moved downward through the opening part 126*a*. More precisely, after the second shelf 170 is first mounted to the guide frame 110 through the opening part 126*a*, the second shelf 170 may be moved from the first shelf guide 126 toward the second shelf guide 127. Next, the first shelf 150 may be mounted to the first shelf guide 126 through the opening part 126*a*.

A rotation guide 126*b* may be provided at a side more inner than the first shelf guide 126. When the first shelf 150 rotates relative to the guide frame 110, the rotation guide 126*b* may be considered as an avoiding part to prevent the first shelf 150 from interfering with the first shelf guide 126. To this end, in the side body 111, the rotation guide 126*b* may be configured to be larger in a vertical width than the first shelf guide 126.

The rotation recess 129 may be recessed in the rotation guide 126*b*. The rotation recess 129 may be recessed in the upper part of the rotation guide 126*b*. A rotating protrusion part 159 of the first shelf 150 may be fitted into the rotation recess 129 to be the rotation center of the first shelf 150. The rotation recess 129 may be formed in each of the pair of side bodies 111, and the rotating protrusion part 159 may be provided on each of the opposite side surfaces of the first shelf 150.

In the embodiment, the front end part of the second shelf guide 127 may be blocked. Accordingly, the second shelf 170 may be blocked by the front end part and may be prevented from being removed forward from the second shelf guide 127. Additionally, as illustrated in FIG. 7, the front part of the second shelf guide 127 may be configured to have width decreasing gradually forward, and thus noise occurring when the second shelf 170 is pulled forward may be reduced.

Next, looking at the storage drawer 130, the storage drawer 130 may have an approximately hexahedral shape, and the storage space 130*a* may be defined in the center of the storage drawer 130. The storage space 130*a* may be empty space open upward. When the storage drawer 130 is pulled out from the guide frame 110, the storage space 130*a* may be open upward, and when the storage drawer 130 is moved in the guide frame 110, the storage space 130*a* may be covered by the first shelf 150 and the second shelf 170.

Drawer side parts 131, a drawer rear part 132, and a drawer front part 133 constituting the storage drawer 130 may be connected to each other, and the storage space 130*a* may be defined in a portion covered by the drawer side parts 131, the drawer rear part 132, and the drawer front part 133. Among these, the drawer front part 133 may be a part directed toward a user, and the drawer rear part 132 may be directed toward the inside of the inner casing 1. Furthermore, each of the drawer side parts 131 may be a part guided by the guide frame 110.

The moving rail 135 may be provided in the drawer side part 131. The moving rail 135 may extend along the moving direction of the storage drawer 130. That is, the moving rail 135 may extend in the front-to-rear direction (an X-axis direction of FIG. 1) of the storage drawer 130, and may be a structure protruding from the drawer side part 131.

The rail end part 135*a* may be provided on the end part of the moving rail 135. The rail end part 135*a* may have a larger width than the moving rail 135. The rail end part 135*a* may be fitted into the drawer guide part 121 through the rail entrance 121*a* of the drawer guide part 121. Additionally, the rail end part 135*a* may be held by the rail stopper 121*b* provided in the rail entrance 121*a*, and thus the storage drawer 130 may be prevented from being completely removed from the guide frame 110.

A seating protrusion part 136 may be provided on the drawer side part 131 by being spaced apart from the moving rail 135. In the drawer side part 131, the seating protrusion part 136 may be located behind the rail end part 135*a* and may have a cylindrical shape in the embodiment. The seating protrusion part 136 may be spaced apart from the rail end part 135*a* and may have the same height as the rail end part 135*a*. When the moving rail 135 is completely fitted into the drawer guide part 121, the seating protrusion part 136 may be seated in the innermost space of the drawer guide part 121. Furthermore, the seating protrusion part 136 may have a curved surface and may allow the storage drawer 130 to move smoothly when the storage drawer 130 is fitted to inside of the storage compartment 3 along the guide frame 110.

Referring to FIG. 9, it can be seen that the storage drawer 130 is completely mounted to the guide frame 110. In FIG. 9, the first shelf 150 and the second shelf 170 are omitted, and thus the storage space 130*a* is completely open upward.

Next, the shelves 150 and 170 will be described. The frames of the shelves 150 and 170 may be constituted by the shelf frames 151 and 171, respectively, and the top plates 160 and 180 may be disposed on the shelves 150 and 170, respectively. In this case, the top plates 160 and 180 may be bonded to the adhesive parts 152*b* and 153*b*, and 172*b* formed in the shelf frames 151 and 171, respectively. Hereinafter, the first shelf 150 and the second shelf 170 constituting the shelves 150 and 170 will be sequentially described.

First, as for the function of the first shelf 150, the first shelf 150 (*i*) may function as a shelf on which items P1, P2, and P3 can be seated, and simultaneously, (ii) may be located on the storage drawer 130 and may function as a cover to cover the storage space 130*a*. In addition, (iii) as illustrated in FIG. 7, when the first shelf 150 is rotated, the storage space 130*a* may be opened to store even tall items P1, P2, and P3 in the storage space 130*a*. Finally, (iv) the first shelf 150 may function to guide the movement of the second shelf 170 such that the second shelf 170 can overlap the first shelf 150.

The first shelf 150, together with the second shelf 170, may function as a shelf. Referring to FIG. 10, the upper surface of the first shelf 150 and the upper surface of the second shelf 170 may constitute the same plane. In FIG. 10, A denotes an imaginary extension line connecting the upper surface of the first shelf 150 with the upper surface of the second shelf 170. Accordingly, even if a user places items P1, P2, and P3 on the first shelf 150 and the second shelf 170, the items P1, P2, and P3 may be prevented from being unstably stored due to inclination caused by a step between the first shelf 150 and the second shelf 170. This structure will be described again below.

Referring to FIG. 11, the first shelf 150 may include a first shelf frame 151, and a first top plate 160 coupled to the first shelf frame 151. In the embodiment, the first shelf frame 151 may be roughly "U" shaped and made of a synthetic resin material. The first shelf frame 151 may constitute the frame of the first shelf 150, and the first top plate 160 may cover the upper part of the storage space 130*a*, and a storage place on which items P1, P2, and P3 can be seated may be provided on the first top plate 160.

Looking at the structure of the first shelf frame 151, the first shelf frame 151 may include a pair of first shelf bodies 152 disposed to be spaced apart from each other, and a first front body 153 which opposite ends are connected to the front end parts of the pair of first shelf bodies 152, respectively. The pair of first shelf bodies 152 may be coupled respectively to the pair of side bodies 111 of the guide frame 110. In addition, when the second shelf 170 is extended from the first shelf 150, the first front body 153 may be disposed to face the rear end part of the second shelf 170.

The first top plate 160 may have the shape of a quadrangular plate, and may be made of transparent or translucent material. For example, the first top plate 160 may be made of glass or a transparent synthetic resin material. When the first top plate 160 is transparent, the storage space 130*a* may be observed through the first top plate 160. The items P1, P2, and P3 may be seated on the upper surface 161 of the first top plate 160.

The edges of the first top plate 160 may be in close contact with the pair of first shelf bodies 152 and the first front body 153. Since the first top plate 160 is seated on the pair of first shelf bodies 152 and the first front body 153, the edges of the first top plate 160 may not be covered by the first shelf frame 151, and the entire area thereof may be exposed upward. Through this structure, the beauty of the storage assembly 100 may be improved.

The edges of the first top plate 160 may be bonded and fixed to the upper surface 152*a* of the first shelf body 152 and the upper surface 153*a* of the first front body 153. Referring to FIGS. 12 and 13, a first adhesive part 152*b* and 153*b* may be depressed in the upper surface of the first shelf frame 151. Adhesive may be applied to the first adhesive part 152*b* and 153*b*, and may fix the first top plate 160 to the upper surface of the first shelf frame 151. Here, the adhesive may be considered as a sealant and may use various materials having adhesive components. For example, the adhesive may be a PVC-based, synthetic rubber-based, butyl rubber-based, epoxy resin-based, polyurethane-based, or silicone-based adhesive.

The first adhesive part 152*b* and 153*b* may include a side adhesive groove 152*b* and a front adhesive groove 153*b*. The side adhesive groove 152*b* may be depressed in the upper surface 152*a* of the first shelf body 152, and the front adhesive groove 153*b* may be depressed in the upper surface 153*a* of the first front body 153. In the embodiment, the side adhesive groove 152*b* and the front adhesive groove 153*b* may be continuously connected to each other.

Referring to FIG. 13, the side adhesive groove 152*b* may include a first side adhesive groove 152*b*1 disposed at a relatively inner side of the first shelf body, and a second side adhesive groove 152*b*2 disposed at a more outer side than the first side adhesive groove 152*b*1. The first side adhesive groove 152*b*1 and the second side adhesive groove 152*b*2 may continuously extend along the longitudinal direction of the first shelf body 152.

Accordingly, when the side adhesive groove 152*b* includes multiple side adhesive grooves, an adhesion area between the first top plate 160 and the first shelf body 152 may increase and thus the first top plate 160 may be more securely fixed thereto. Furthermore, even if the first top plate 160 is tilted or twisted, a minimum adhesion area may be secured. For example, the lower surface of the first top plate 160 may be in close contact with the first side adhesive groove 152*b*1 but may be spaced apart from the second side adhesive groove 152*b*2. Even in this case, the first top plate 160 may be fixed to the first shelf body 152 by an adhesive injected into the first side adhesive groove 152*bl*.

In the embodiment, the first side adhesive groove 152*b*1 may be configured to be wider in the left-to-right width than the second side adhesive groove 152*b*2, and the second side adhesive groove 152*b*2 may be configured to be deeper in the depressed depth than the first side adhesive groove 152*b*1. The first side adhesive groove 152*b*1 may allow a wide adhesion area between the first top plate 160 and the first shelf body 152 to be secured, and the second side adhesive groove 152*b*2 may prevent adhesive leaking the first side adhesive groove from going to the outside of the upper surface 152*a* of the first shelf body 152. That is, adhesive leaking from the first side adhesive groove 152*b*1 may move into the second side adhesive groove 152*b*2 to be collected therein, and may not be discharged any longer to the outside.

Of course, since the second side adhesive groove 152*b*2 may also be filled with adhesive, the second side adhesive groove 152*b*2, together with the first side adhesive groove 152*b*1, may function to increase adhesive force between the lower surface of the first top plate 160 and the upper surface 152*a* of the first shelf body 152.

The first side adhesive groove 152*b*1 and the second side adhesive groove 152*b*2 may include two first side adhesive grooves and two second side adhesive grooves, respectively, formed in the upper surface 152*a* of the first shelf body 152. Alternatively, the first side adhesive groove 152*b*1 and the second side adhesive groove 152*b*2 may include one first side adhesive groove and one second side adhesive groove, respectively, or any one of the first side adhesive groove 152*b*1 and second side adhesive groove 152*b*2 may include one side adhesive groove and a remaining one thereof may include two side adhesive grooves.

In the embodiment, the front adhesive groove 153*b* may include one front adhesive groove, and each of the opposite ends of the front adhesive groove 153*b* may be connected to the first side adhesive groove 152*b*1. Of course, the front adhesive groove 153*b* may include multiple front adhesive grooves.

For reference, FIG. 14 illustrates a first shelf body 1152 according to another embodiment. The same structure as the structure of the first shelf body 152 of the previous embodiment is assigned a number to which 1000 is added and a description thereof will be omitted. A side adhesive groove 1152*b* may be formed in the upper surface 1152*a* of the first shelf body 1152. The side adhesive groove 1152*b* may be configured as one side adhesive groove and may extend in a front-to-rear direction along the longitudinal direction of the first shelf body 1152. The side adhesive groove 1152*b* may be configured to be depressed in the center part of the upper surface 1152*a* of the first shelf body 1152.

Referring back to FIG. 10, a cover part 153' may be provided on the first front body 153 so as to cover the peripheral surface of the front of the first top plate 160. The cover part 153' may protrude upward and may cover the peripheral surface of the front of the first top plate 160. In this case, when the second shelf 170 is extended from the first shelf 150, the upper surface 161 of the first top plate 160, the upper surface 181 of the second top plate 180, and the upper surface of the cover part 153' may constitute the same plane. An imaginary extension line A indicates that the upper surface 161 of the first top plate 160, the upper surface 181 of the second top plate 180, and the upper surface of the cover part 153' constitute the same plane.

Looking at the embodiment of FIGS. 11 to 13, the connecting guide part 155 may be formed in the first shelf body 152. The connecting guide part 155 may be formed in each of the inner surfaces of the pair of first shelf bodies 152 facing each other by being recessed therefrom. The connecting guide part 155 may be connected to the shelf guide part 125. More precisely, the connecting guide part 155 may be connected to a guide body 174 (a shelf rail) in the second shelf guide 127 of the shelf guide part 125. Accordingly, a second shelf body 172 of the second shelf 170 may be guided along a path connected to the second shelf guide 127 and the connecting guide part 155.

The connecting guide part 155 may be open forward. The connecting guide part 155 may have a guide entrance 155*a* formed therein, and the guide entrance 155*a* may be open toward the second shelf 170. Accordingly, in a state in which the second shelf 170 is located in the second shelf guide 127, the second shelf 170 may move to the connecting guide part 155.

A guide stopper 156 may be provided on an end part of the connecting guide part 155. The guide stopper 156 may function to limit the moving distance of the second shelf 170 when the second shelf 170 moves to the lower side of the first shelf 150 such that the first shelf 150 and the second shelf 170 are stacked on each other. The guide stopper 156 may protrude from the connecting guide part 155 and may interfere with the end part of the second shelf body 172 of the second shelf 170.

The rotating protrusion part 159 may protrude on the first shelf body 152. The rotating protrusion part 159 may protrude from a surface of the second shelf body 152 at a side opposite to the connecting guide part 155. The rotating protrusion part 159 may have an approximately cylindrical shape, and may be fitted into the rotation recess 129 formed in the rotation guide 126*b*. The rotating protrusion part 159 may be the rotation center of the first shelf 150.

In FIG. 15, the second shelf 170 is illustrated. The second shelf 170 may include a second shelf frame 171 and a second top plate 180 fixed to the second shelf frame 171. In the embodiment, the second shelf frame 171 may be approximately "U" shaped, and be made of a synthetic resin material. The second shelf frame 171 may constitute the frame of the second shelf 170, and the second top plate 180 may cover the upper part of the storage space 130*a* and may provide a storage place, in which the items P1, P2, and P3 can be seated, on the upper part of the second top plate 180.

Looking at the structure of the second shelf frame 171, the second shelf frame 171 may include the pair of second shelf bodies 172 disposed to be spaced apart from each other, and the second front body 178 disposed in front of the pair of second shelf bodies 172. The pair of second shelf bodies 172 may be coupled respectively to the pair of side bodies 111 of the guide frame 110. Furthermore, when the second shelf 170 is extended from the first shelf 150, the rear end part of the second shelf body 172 may be disposed to face the front end part of the first shelf 150.

In the embodiment, the pair of second shelf bodies 172 may be disposed respectively on the lower sides of the left and right edges of the second top plate 180. The lower surfaces of the left and right edges of the second top plate 180 may be bonded respectively to the upper surfaces 172*a* of the pair of second shelf bodies 172. A specific bonding structure between the second shelf body 172 and the second top plate 180 will be described below.

The guide body 174 to be described later may be provided on one side surface of the second shelf body 172, and may be regarded as the shelf rail. The shelf rail may be a part which is disposed in the second shelf guide 127 and moves along the connecting guide part 155 when the second shelf 170 is moved rearward. The shelf rail may be a structure more protruding from the side surface of the second shelf body 172.

The second front body may be assembled with the second top plate 180 in such a manner that the front body is not disposed under the edge of the front surface of the second top plate 180 but is fitted on the front surface of the second top plate 180. Accordingly, the upper surface of the front body may be located higher than the upper surface 181 of the second top plate 180. In this case, items P1, P2, and P3 placed on the second top plate 180 may be prevented from rolling and falling in front of the second top plate 180, and a user may grip the front body and may easily push or pull the second top plate 180. Reference numeral 178*a* denotes a coupling groove into which the front edge of the second top plate 180 is fitted.

Referring to FIG. 16, a second adhesive part 172*b* may be formed in the upper surface 172*a* of the second shelf body 172. Adhesive may be applied to the second adhesive part 172*b*, and the adhesive may fix the second top plate 180 to the upper surface of the second shelf frame 171. Here, the adhesive may be considered as a sealant and may use various materials having adhesive components.

The second adhesive part 172*b* may be depressed in the upper surface 172*a* of the second shelf body 172. The second adhesive part 172*b* may extend in a front-to-rear direction which is the longitudinal direction of the second shelf body 172, and may have a shape depressed in the second shelf body 172.

Referring to FIG. 17, the second adhesive part 172*b* may include a main adhesive groove 172*b*1 disposed at a relatively inner side of the second shelf body, and an auxiliary adhesive groove 172*b*2 disposed at a more outer side than the main adhesive groove 172*b*L. The main adhesive groove 172*b*1 and the auxiliary adhesive groove 172*b*2 may continuously extend along the longitudinal direction of the second shelf body 172.

Accordingly, when the second adhesive part 172*b* includes multiple second adhesive parts, an adhesion area between the second top plate 180 and the second shelf body 172 may increase such that the second top plate 180 can be more securely fixed to the second shelf body. Additionally, even if the second top plate 180 is tilted or twisted, a minimum adhesion area may be secured. For example, the lower surface of the second top plate 180 may be in close contact with the main adhesive groove 172*b*1 but may be spaced apart from the auxiliary adhesive groove 172*b*2. Even in this case, the second top plate 180 may be fixed to the second shelf body 172 by adhesive injected into the main adhesive groove 172*b*1.

In the embodiment, the main adhesive groove 172*b*1 may be configured to be wider in a left-to-right width than the auxiliary adhesive groove 172*b*2, and the auxiliary adhesive groove 172*b*2 may be configured to be deeper in depressed depth than the main adhesive groove 172*bl*. The main adhesive groove 172*b*1 may allow a wide adhesion area between the second top plate 180 and the second shelf body 172 to be secured, and the auxiliary adhesive groove 172*b*2 may prevent adhesive leaking from the main adhesive groove 172*b*1 from going to the outside of the upper surface 172*a* of the second shelf body 172. That is, adhesive leaking from the main adhesive groove 172*b*1 may move into the auxiliary adhesive groove 172*b*2 to be collected therein, and may not be discharged any longer to the outside.

Of course, since the auxiliary adhesive groove 172*b*2 may also be filled with adhesive, the auxiliary adhesive groove 172*b*2, together with the main adhesive groove 172*b*1, may function to increase adhesive force between the lower surface of the second top plate 180 and the upper surface 172*a* of the second shelf body 172.

The auxiliary adhesive groove 172*b*2 may include two auxiliary adhesive grooves disposed respectively at opposite sides of the main adhesive groove 172*bl*. Alternatively, auxiliary adhesive groove 172*b*2 may include only one auxiliary adhesive groove formed in the upper surface 172*a* of the second shelf body 172, or the main adhesive groove 172*b*1 and the auxiliary adhesive groove 172*b*2 may include two main adhesive grooves and two auxiliary adhesive grooves, respectively.

For reference, FIG. 18 illustrates a second shelf body 1172 according to the another embodiment. The same structure as the structure of the second shelf body 172 of the previous embodiment is assigned a number to which 1000 is added and a description thereof will be omitted. A second adhesive part 1172*b* may be formed in an upper surface 1172*a* of the second shelf body 1172. The second adhesive part 1172*b* may be configured as one second adhesive part, and may extend in a front-to-rear direction along the longitudinal direction of the second shelf body 1172. The second adhesive part 1172*b* may be configured to be depressed in the center part of the upper surface 1172*a* of the second shelf body 1172.

Referring back to FIG. 17, the second shelf body 172 may be provided with a guide fence 173. The guide fence 173 may protrude upward from the upper surface 172*a* of the second shelf body 172. The guide fence 173 may extend in the same direction as the direction of the second adhesive part 172*b*. The edge of the side surface of the second top plate 180 may be seated on the guide fence 173, and thus the guide fence 173 may support the side surface of the second top plate 180. The surface of the guide fence 173 may be formed as a curved surface corresponding to the edge of the second top plate 180.

The second shelf body 172 may further include the guide body 174. The guide body 174 may protrude more to the outside from the second shelf body 172. The guide body 174 may be a part guided along the second shelf guide 127 of the shelf guide part 125 and the connecting guide part 155. The guide body 174 may move forward and rearward while the guide body 174 is fitted into the second shelf guide 127 and the connecting guide part 155. Reference numeral 176 denotes an extension part extending downward from the guide body 174.

The second shelf body 172 may be provided with the guide protrusion part 177. The guide protrusion part 177 may protrude downward from the end part of the second shelf body 172. The guide protrusion part 177 may be a part moving downward on the step part 128 of the shelf guide part 125. Accordingly, the entirety of the second shelf 170 may move in an inclined direction. When the rear end part of the second shelf 170 moves downward on the step part 128, the entirety of the second shelf 170 may be inclined. In this state, the second shelf 170 may move to the lower side of the first shelf 150, and thus the first shelf 150 and the second shelf 170 may be stacked on each other.

When the second shelf body 172 moves from the second shelf guide 127 of the side body 111 to the connecting guide part 155 of the first shelf 150, the second top plate 180 may be disposed under the first top plate 160 to overlap the first top plate. This state is illustrated in FIGS. 5 and 6.

Next, a process in which the storage assembly 100 of the embodiment operates will be described with reference to FIGS. 4 to 7. First, as illustrated in FIG. 4, the second shelf 170 may be extended from the first shelf 150. Accordingly, the upper part of the storage space 130*a* may be covered, and items P1, P2, and P3 may be seated on the first shelf 150 and the second shelf 170. That is, in FIG. 4, each of the first shelf 150 and the second shelf 170 functions as the shelf and cover of the storage drawer 130.

In this state, when the second shelf 170 is moved to the lower side of the first shelf 150 to overlap the first shelf 150, the second shelf 170 may be in the state illustrated in FIG. 5. More specifically, when a user pushes the second shelf 170 rearward, the second shelf 170 may be disposed under the first shelf 150. The step part 128 may be formed between the first shelf guide 126 and the second shelf guide 127, and thus when the second shelf 170 moves from the second shelf guide 127 toward the first shelf guide 126, the rear end part of the second shelf 170 provided with the guide protrusion part 177 may incline downward.

In this case, the guide protrusion part 177 provided in the second shelf 170 may move downward on the step part 128, and accordingly, the entirety of the second shelf 170 may move in an inclined direction. When the rear end part of the second shelf 170 moves downward on the step part 128, the entirety of the second shelf 170 may be in an inclined state. In this state, the second shelf 170 may move to the lower side of the first shelf 150 and thus the first shelf 150 and the second shelf 170 may be stacked on each other.

In this case, a position at which the second shelf 170 is initially located may be open upward, so a user may store tall items P1, P2, and P3 in the storage space 130*a*. This state is illustrated in FIG. 6.

When a user intends to store more tall items P1, P2, and P3, the first shelf 150 and the second shelf 170 may be stacked on each other and rotated. The second shelf 170 is mounted in the connecting guide part 155 of the first shelf 150, and thus when the first shelf 150 is rotated, the second shelf 170 may also be rotated. In this case, relative to the rotating protrusion part 159 of the first shelf 150 as the rotation center, the first shelf 150 and the second shelf 170 may rotate together. This state is illustrated in FIG. 7.

That is, as illustrated in FIG. 5, a user may allow the second shelf 170 to overlap the first shelf 150 so as to open only the front part of the storage drawer 130 upward, or as illustrated in FIG. 7, the second shelf 170 and the first shelf 150 overlapping each other may be folded to open all of the front and rear parts of the storage drawer 130. Accordingly, a user may variously modify the storage assembly 100 according to his/her usage environment.

Meanwhile, referring to FIGS. 2 and 3, a user may take out the items P1, P2, and P3 by pulling the storage drawer 130 forward. FIG. 2 illustrates a state in which the storage drawer 130 is mounted inside the guide frame 110, and FIG. 3 illustrates a state in which the storage drawer 130 is moved out by a user pulling out the storage drawer 130. When the storage drawer 130 is moved forward, a user may easily take out items P1, P2, and P3 without the items interfering with other shelves (not shown) at an upper side.

In addition, as described above, in the embodiment, the first shelf 150 and the second shelf 170 may operate independently of the storage drawer 130. Accordingly, even if the storage drawer 130 is removed, the first shelf 150 and the second shelf 170 may remain in the refrigerator and may function to perform the function of a shelf, and a user may take out or store items by pulling out only the storage drawer 130. Accordingly, a cover for covering the storage space 130*a* and a shelf to place items on are not required to be separately provided.

The above description is merely an exemplary description of the technical idea of the present disclosure, and those with ordinary knowledge in the technical field to which the present disclosure belongs may make various modifications and changes within a scope that does not deviate from the essential characteristics of the present disclosure. Accordingly, the embodiments disclosed in the present disclosure are for explaining rather than limiting the technical idea of the present disclosure, and the scope of the technical idea of the present disclosure is not limited by these embodiments. The scope of protection of the present disclosure should be interpreted by the claims below, and all technical ideas within a scope equivalent thereto should be interpreted as being included in the scope of the present disclosure.

DESCRIPTION OF THE REFERENCE NUMERALS IN THE DRAWINGS

1: Inner casing 3: Storage compartment
100: Storage assembly 110: Guide frame
111: Side body 115: Rear body
121: Drawer guide part 125: Shelf guide part
126: First shelf guide 127: Second shelf guide
128: Step part 130: Storage drawer
150: First shelf 151: First shelf frame
152: First shelf body 152*b*, 153*b*: First adhesive part
152*b*: Side adhesive groove 153: First front body
153*b*: Front adhesive groove 155: Connecting guide part
156: Guide stopper 159: Rotating protrusion part
160: First top plate 170: Second shelf
171: Second shelf frame 172: Second shelf body
172*b*: Second adhesive part 174: Guide body
177: Guide protrusion part 178: Second front body
180: Second top plate P1, P2, P3: Items

The invention claimed is:

1. A refrigerator comprising:
a cabinet having a storage compartment formed therein; and
a storage assembly installed in the storage compartment and having a storage space defined therein,
wherein the storage assembly comprises:
a guide frame disposed in the storage compartment and provided with a drawer guide part and a shelf guide part having heights different from each other;
a storage drawer which has the storage space defined therein and moves along the drawer guide part; and
a plurality of shelves disposed on the storage space,
wherein each of the shelves comprises:
a shelf frame coupled to the shelf guide part; and
a top plate coupled to an upper surface of the shelf frame,
wherein the upper surface of the shelf frame is open toward a lower surface of the top plate and has an adhesive part depressed therein such that adhesive is filled in the adhesive part,
wherein the shelf frame comprises a pair of shelf bodies disposed at opposite sides thereof, respectively, by being spaced apart from each other, and a front body located between the pair of shelf bodies to connect the pair of shelf bodies to each other, the front body being disposed on a front of the shelf frame,
wherein the adhesive part is continuously formed in upper surfaces of the pair of shelf bodies and an upper surface of the front body, and
wherein the depressed adhesive part on the upper surface of the shelf frame includes a first side adhesive groove extending along a longitudinal direction of each of the shelf bodies, and a parallel second side adhesive groove disposed outward with respect to the first side adhesive groove and at each of opposite sides thereof.

2. The refrigerator of claim 1, wherein the plurality of shelves comprises:
a first shelf coupled rotatably to the shelf guide part, and comprising a first shelf frame and a first top plate coupled to an upper end of the first shelf frame; and
a second shelf which moves along the shelf guide part and the first shelf frame and comprises a second shelf frame and a second top plate coupled to an upper end of the second shelf frame, and
wherein a first adhesive part and a second adhesive part are recessed in upper surfaces of the first shelf frame and the second shelf frame, respectively, the first adhesive part and the second adhesive part being open toward lower surfaces of the first top plate and the second top plate, respectively.

3. The refrigerator of claim 2, wherein the first adhesive part comprises:
a side adhesive groove formed in an upper surface of each of a pair of first shelf bodies disposed respectively on opposite sides of the first shelf frame; and
a front adhesive groove formed in an upper surface of a first front body disposed on a front of the first shelf frame.

4. The refrigerator of claim 1, wherein the first side adhesive groove is configured to be wider in a left-to-right width than the second side adhesive groove, and the second side adhesive groove is configured to be deeper in a depressed depth than the first side adhesive groove.

5. The refrigerator of claim 2, wherein connecting guide parts are formed in the pair of first shelf bodies, respectively, to face each other, and the second shelf slides forward and rearward along the shelf guide part and each of the connecting guide parts, and when the second shelf moves from the shelf guide part to the connecting guide parts, the second shelf overlaps the first shelf.

6. The refrigerator of claim 2, wherein the second adhesive part comprises:
a main adhesive groove depressed in an upper surface of a second shelf body disposed on each of opposite sides of the second shelf frame and extending along a longitudinal direction of the second shelf body; and
an auxiliary adhesive groove formed in parallel with the main adhesive groove and disposed at a more outer side than the main adhesive groove.

7. The refrigerator of claim 6, wherein the main adhesive groove is configured to be wider in a left-to-right width than the auxiliary adhesive groove, and the auxiliary adhesive groove is configured to be deeper in a depressed depth than the main adhesive groove.

8. The refrigerator of claim 6, wherein a guide fence protrudes on the upper surface of the second shelf body, and extends in a direction parallel with the second adhesive part.

9. A refrigerator comprising:
a cabinet having a storage compartment formed therein; and
a storage assembly installed in the storage compartment and having a storage space defined therein,
wherein the storage assembly comprises:
a guide frame disposed in the storage compartment and provided with a drawer guide part and a shelf guide part having heights different from each other;
a storage drawer which has the storage space defined therein and moves along the drawer guide part;
a first shelf which covers a rear part of an upper part of the storage space and is provided with connecting guide parts, each of the connecting guide parts being connected to the shelf guide part; and
a second shelf which covers a front part of the upper part of the storage space and slides forward and rearward along the shelf guide part and a connecting guide part of the connecting guide parts, wherein when the second shelf moves from the shelf guide part to the connecting guide part, the second shelf overlaps the first shelf, wherein the first shelf is coupled rotatably to the guide frame such that the first shelf and the second shelf overlapping the first shelf rotate together, and wherein each of the first shelf and the second shelf includes a glass top plate bonded to paired shelf bodies by an adhesive, wherein an upper surface of each of the paired shelf bodies is open toward a lower surface of the glass top plate and has an adhesive part depressed therein such that the adhesive is filled in the adhesive part, wherein the adhesive part on the upper surface of each of the paired shelf bodies includes a first side adhesive groove and a parallel second side adhesive groove disposed outward with respect to the first side adhesive groove and at each of opposite sides thereof, and wherein, when the second shelf is positioned in front of the first shelf, the two glass top plates are coplanar.

10. The refrigerator of claim 9, wherein a moving rail of the storage drawer is coupled to the drawer guide part, and a shelf rail of the second shelf is coupled to the shelf guide part.

11. The refrigerator of claim 9, wherein each of the drawer guide part and the shelf guide part is provided on the same surface of the guide frame, and the drawer guide part is provided at a position lower than a position of the shelf guide part.

12. The refrigerator of claim 9, wherein the shelf guide part comprises:

a first shelf guide assembled with the first shelf; and a second shelf guide connected to the first shelf guide and assembled with the second shelf, and wherein the first shelf guide is configured to be larger in a vertical width than the second shelf guide such that a step part is formed between the first shelf guide and the second shelf guide.

13. The refrigerator of claim 12, wherein a rotation recess into which a rotating protrusion part of the first shelf is inserted is recessed in the first shelf guide.

14. The refrigerator of claim 9, wherein a front of the connecting guide part directed toward the second shelf is open, and a guide protrusion part inserted into the connecting guide part protrudes on a side surface of the second shelf.

15. The refrigerator of claim 9, wherein when the second shelf is extended from the first shelf, an upper surface of the first shelf and an upper surface of the second shelf constitute the same plane.

16. The refrigerator of claim 12, wherein an upper part of the first shelf guide is open upward, and each of the first shelf and the second shelf is assembled with the guide frame through the upper part of the first shelf guide.

17. The refrigerator of claim 12, wherein the guide frame comprises:

a pair of side bodies disposed to be spaced apart from each other, each of the side bodies being provided with the first shelf guide and the second shelf guide; and a rear body whose opposite ends are connected to the pair of side bodies, respectively, with a rear end part of the first shelf being disposed on the rear body.

* * * * *